US005925842A

United States Patent [19]

Saito

[11] Patent Number: 5,925,842

[45] Date of Patent: Jul. 20, 1999

[54] ELECTRONIC MUSIC TONE GENERATOR WITH POWER SAVING CONTROL

[75] Inventor: Tsutomu Saito, Hamamatsu, Japan

[73] Assignee: Kabushiki Kaisha Kawai Gakki, Shizuoka-ken, Japan

[21] Appl. No.: 09/007,244

[22] Filed: Jan. 14, 1998

[30] Foreign Application Priority Data

Jan. 17, 1997 [JP] Japan ..... 9-019858
Jan. 17, 1997 [JP] Japan ..... 9-019859

[51] Int. Cl.[6] ..... G10H 1/057; G10H 7/02

[52] U.S. Cl. ..... 84/604; 84/617; 84/627; 84/655; 84/663

[58] Field of Search ..... 84/604–607, 615, 84/617, 627, 653, 655, 663, 678, 682, 17–23, 115

[56] References Cited

U.S. PATENT DOCUMENTS

| | | | |
|---|---|---|---|
| Re. 31,090 | 11/1982 | Yamaga et al. | 84/617 |
| 3,697,661 | 10/1972 | Deutsch | 84/655 |
| 3,899,951 | 8/1975 | Griffith et al. | 84/617 |
| 4,031,786 | 6/1977 | Kaplan | 84/655 |
| 4,141,268 | 2/1979 | Kugisawa | 84/617 |
| 4,302,999 | 12/1981 | Okumura | 84/605 |
| 4,357,849 | 11/1982 | Ezawa et al. | 84/617 |
| 4,419,917 | 12/1983 | Sato | 84/653 |

*Primary Examiner*—Stanley J. Witkowski
*Attorney, Agent, or Firm*—Hill & Simpson

[57] ABSTRACT

A waveform generator LSI generates waveform data in units of time slots corresponding to tone generation channels in accordance with tone control data assigned to the individual channels, and accumulates waveform data for the individual channels to form at least one polyphonic tone data. The tone control data are updated by time division control in units of time slots of the channels. By suspending update of control data in the time slot of an unused channel in accordance with data indicating the used/unused status of each channel, switching of CMOS elements composing the waveform generator LSI is suppressed so that the LSI operates at low power. In a system using a waveform memory outside the waveform generator LSI, the read address to be supplied to the waveform memory in the time slot of an unused channel is fixed at a previous value, thus also attaining power savings of the external memory.

23 Claims, 16 Drawing Sheets

110a
100
USE
ASSIGN-MENT MEM
6543 210
111
COUNTER
CK
Q1
Q2
Q3
112
CK
COUNTER
CK
Q4
Q5
Q6
Q7
113
114
115
116
117
119
RST
SCK
CCK
Dadr'
102a
118a
118b
D
Q
G
R
t0
END
RST

ELECTRONIC MUSIC TONE GENERATOR WITH POWER SAVING CONTROL

BACKGROUND OF THE INVENTION

1. Field of the Invention

The present invention relates to an electronic music tone generator applied to apparatuses such as electronic musical instruments, Karaoke apparatuses, DTM (Desk Top Music) apparatuses, and the like for electronically generating music tones using sound source LSIs (Large Scale Integrated Circuits) made up of CMOSs (Complementary Metal Oxide Semiconductors).

2. Description of the Related Art

Conventionally, an electronic musical instrument that can time-divisionally produce a plurality of tones to sound at the same time is known. Such electronic musical instrument time-divisionally reads out waveform data of music tones corresponding to keyboard operations from a waveform ROM (Read Only Memory), and assigns them to tone generation channels (music tone generation channels) to produce tones, so that the number of tones that can be simultaneously produced in accordance with the number of channels prepared for generating music tones.

In the above-mentioned conventional electronic musical instrument, a speaker drive circuit consumes the largest electric power, and requires electric power about an order of magnitude larger than that of a tone generator even at normal tone volume.

In view of this problem, a digital electronic musical instrument which attains power savings using a 3 V power supply in place of a popular 5 V power supply by omitting a speaker is known.

However, such electronic musical instrument cannot attain power savings more than electric power required for the speaker.

More specifically, since the conventional electronic musical instrument can attain power savings by omitting the speaker but does not aim at attaining power savings by the tone generator itself, total power savings cannot be done.

Especially, since the tone generator of the conventional electronic musical instrument time-divisionally makes arithmetic operations for all the prepared channels regardless of used or unused channels, electric power required for the arithmetic operations for unused channels is wasted.

For this reason, a battery-driven electronic musical instrument or the like can only be used several days due to the service life of batteries.

SUMMARY OF THE INVENTION

The present invention has been made to remove the above-mentioned shortcomings, and has as its object to provide an electronic music tone generator which can totally save power by attaining power saving of a sound source LSI and its peripheral logics (waveform ROM and the like) for electronically generating music tones.

According to the present invention, a music tone generator which time-divisionally generates a plurality of music tone data in units of tone generation channels to form at least one polyphonic tone, comprises:

waveform generator means for generating waveform data in accordance with control data assigned to each channel in each of time slots corresponding to the tone generation channels;

time division control means for updating the control data in each time slot for the channel, and supplying the updated control data to the waveform generator means; and power saving means for suppressing operation of the waveform generator means by suspending update of the control data in a time slot of an unused channel in accordance with data indicating used/unused status of each channel.

DETAILED DESCRIPTION OF THE PREFERRED EMBODIMENTS

The preferred embodiments of the present invention will now be described with the aid of the accompanying drawings.

First Embodiment

The first embodiment will first be described.

Figure 1:
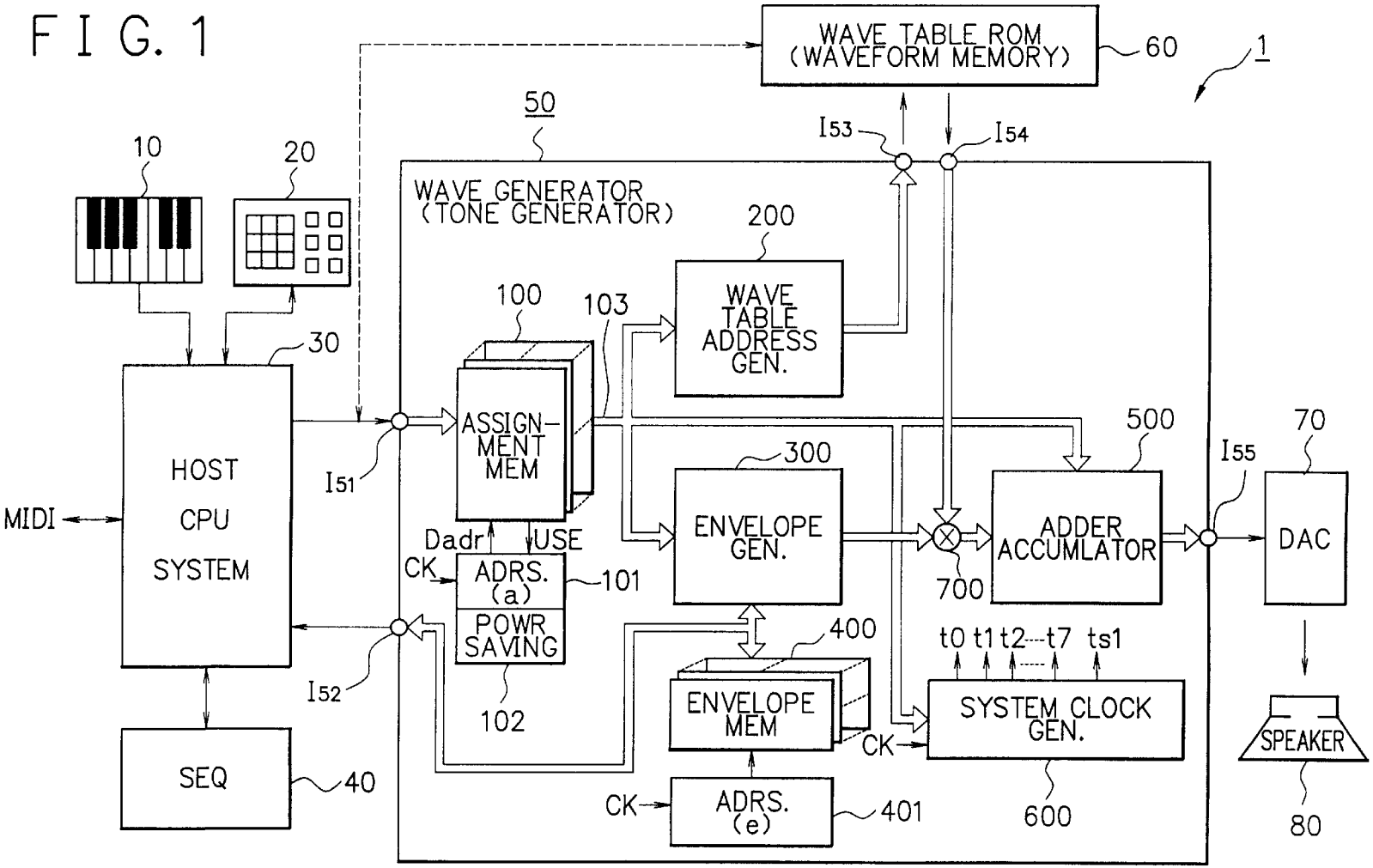
FIG. 1 is a block diagram showing the arrangement of an electronic musical instrument to which an electronic music tone generator according to the present invention is applied in the first embodiment.

An electronic music tone generator according to the present invention is applied to, e.g., an electronic musical instrument 1 shown in FIG. 1.

As shown in FIG. 1, the electronic musical instrument 1 comprises a keyboard 10, a control panel 20, a sequencer (to be referred to as an SEQ hereinafter) 40, a tone generator (to be also referred to as a wave generator hereinafter) 50, a host CPU (Central Processing Unit) 30 which is connected to the control panel 20, SEQ 40, and wave generator 50 and receives the output from the keyboard 10, a wave table 60 connected to the wave generator 50, a digital/analog converter (to be referred to as a DAC hereinafter) 70 which receives the output from the wave generator 50, and a speaker 80 which receives the output from the DAC 70.

The host CPU 30 can be connected with an external tone generator (not shown) such as another electronic musical instrument, and receives external control information such as a MIDI (Musical Instrument Digital Interface) signal and the like.

The wave generator 50 comprises an assignment memory 100 which receives the output from the host CPU 30 via an input terminal I51, a wave table address generator 200 and envelope generator 300 which respectively receive the output from the assignment memory 100, an envelope memory 400 connected to the envelope generator 300, an adder/accumulator 500 and system clock generator 600 which respectively receive the output from the assignment memory 100, and a multiplier 700 which receives the output from the envelope generator 300 and the output from the wave table 60 via an input terminal I54.

The assignment memory 100 also receives the output from an addressing circuit 101, and the output from the wave table address generator 200 is supplied to the wave table 60 via an output terminal I53.

The envelope memory 400 receives the output from an addressing circuit 401, and the output from the envelope memory 400 is supplied to the host CPU 30 via an output terminal I52.

The adder/accumulator 500 also receives the output from the multiplier 700, and the output from the adder/accumulator 500 is supplied to the DAC 70 via an output terminal I55.

In the above-mentioned electronic musical instrument 1, for example, 16 channels are prepared as tone generation channels (music tone generation channels), and the instrument can time-divisionally generate music tones for 16 channels (16 tones) and can produce them at the same time.

The addressing circuit 101 that supplies an address signal to the assignment memory 100 has a power saving means 102. The assignment memory 100, the addressing circuit 101, and control data pipeline 103 for the output from the assignment memory 100 make up a time division control means.

The operation sequence of the electronic musical instrument 1 will be described below.

The host CPU 30 comprises, e.g., a microcomputer and the like. The host CPU 30 receives keyboard operation information at the keyboard 10, operation information at the control panel 20, output information form the SEQ 40, MIDI information from the above-mentioned external tone generator, and the like, and supplies tone generation commands, mute commands, and the like based on such received information to the wave generator 50 via the input terminal I51.

In the wave generator 50, the command information supplied from the host CPU 30 via the input terminal I51 is stored in the assignment memory 100.

The information (control data) stored in the assignment memory 100 is time-divisionally read out, and the wave table address generator 200 for generating the read address of the wave table 60 and the envelope generator 300 for generating an envelope perform arithmetic operations on the basis of the readout control data.

The read address generated by the wave table address generator 200 is supplied to the wave table 60 via the output terminal I53.

The wave table 60 comprises a ROM, and outputs waveform data to the input terminal I54 in accordance with the read address from the output terminal I53.

Hence, the multiplier 700 receives the waveform data as the output from the wave table 60 via the input terminal I54.

Note that the wave table 60 may comprise a RAM or flash RAM, and the host CPU 30 may access (R/W) it while the wave generator 50 is not active.

An envelope value obtained by the arithmetic operation of the envelope generator 300 is also supplied to the multiplier 700.

Hence, the multiplier 700 multiplies the waveform data read out from the wave table 60 in accordance with the read address generated by the wave table address generator 200 by the envelope value obtained by the envelope generator 300.

The adder/accumulator 500 accumulates the products output from the multiplier 700, and outputs the accumulation result of waveform data for 16 channels during one sample period.

The accumulation result of the adder/accumulator 500 serves as the output from the wave generator 50, and is supplied to the DAC 70 via the output terminal I55, thus producing tones from the speaker 80.

The internal arrangement of the wave generator 50 will be described in detail below.

Figure 2:
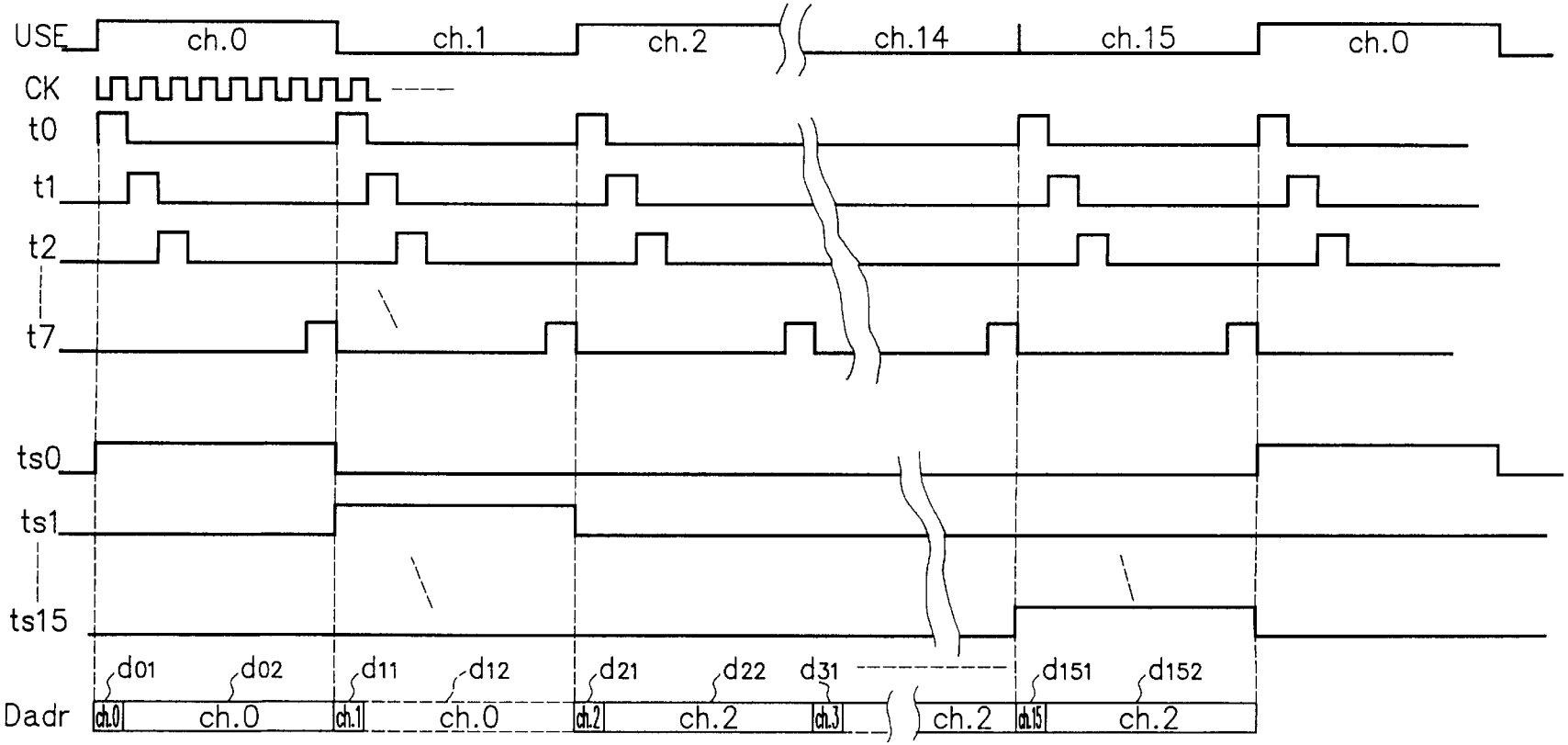
FIG. 2 is a timing chart showing timing clocks in a wave generator in the electronic musical instrument.

FIG. 2 is a timing chart showing the timing clocks in the wave generator 50. A signal USE and timing signals t0 to t17 and ts0 to ts15 in FIG. 2 are generated by the system clock generator 600. Also, a signal Dadr in FIG. 2 is generated by the addressing circuit 101.

The signal USE indicates used/unused status of channels time-divisionally (time division for 16 channels from ch.0 to ch.15), and is set at "1" when the channel of an allocated time slot is in use; otherwise, it is set at "0". Hence, in FIG. 2, two channels ch.0 and ch.2 are in use.

The timing signal to is always output independently of the value of the signal USE, and the signal USE of each time division channel is latched in response to this timing signal t0.

Other timing signals t1 to t7 are also always output independently of the value of the signal USE, and those latch clocks are supplied to latch circuits that make up pipeline (to be described later).

The timing signals ts0 to ts15 respectively correspond to channels ch.0 to ch.15, and change to "1" at the timings of the corresponding channels.

The signal Dadr controls output data from the assignment memory 100, and consists of number information dx1 and address information dx2 for each channel.

At the timing of the timing signal t0, number information dx1 and dx2 for channel ch.X at that time are output to the assignment memory 100.

More specifically, at the timing of the timing signal ts0, number information d01 (=ch.0) of channel ch.0 and address information d02 indicating the storage address of information of channel ch.0 in the assignment memory 100 are output to the assignment memory 100; number information d11 (=ch.1) of channel ch.1 and address information d12 indicating the storage address of information of channel ch.1 in the assignment memory 100 are output to the assignment memory 100, and likewise, number information dx1 and address information dx2 of channels ch.2 to ch.15 are output to the assignment memory 100.

In accordance with the above-mentioned signal Dadr, the assignment memory 100 outputs information of channel ch.X. In this embodiment, if channel ch.X is an unused channel, various kinds of information of that channel are inhibited from being output from the assignment memory 100. Note that in an unused channel the assignment memory 100 still stores previous information that has been set in foregoing used state.

For this reason, in the signal Dadr, in case of an unused channel (in FIG. 2, channels ch.1 and ch3 to ch.15), the output contents of the address information dx2 of the immediately preceding used channel (in FIG. 2, channels ch.0 and ch.2) are output again as the address information dx2 of that unused channel.

Hence, in FIG. 2, in case of channel ch.1, the output address information of immediately preceding channel ch.0 is output again as its address information d12, and in case of channel ch.3, the output address information of immediately preceding channel ch.2 is output again as its address information d32.

Note that the number information dx1 of each channel always includes the corresponding channel number.

The system clock generator 600 that generates the above mentioned signal USE and timing signals t0 to t7 and ts0 to ts15, and the addressing circuit 101 that generates the signal Dadr will be explained in detail later.

The assignment memory 100 will be described in detail below.

Figure 3:
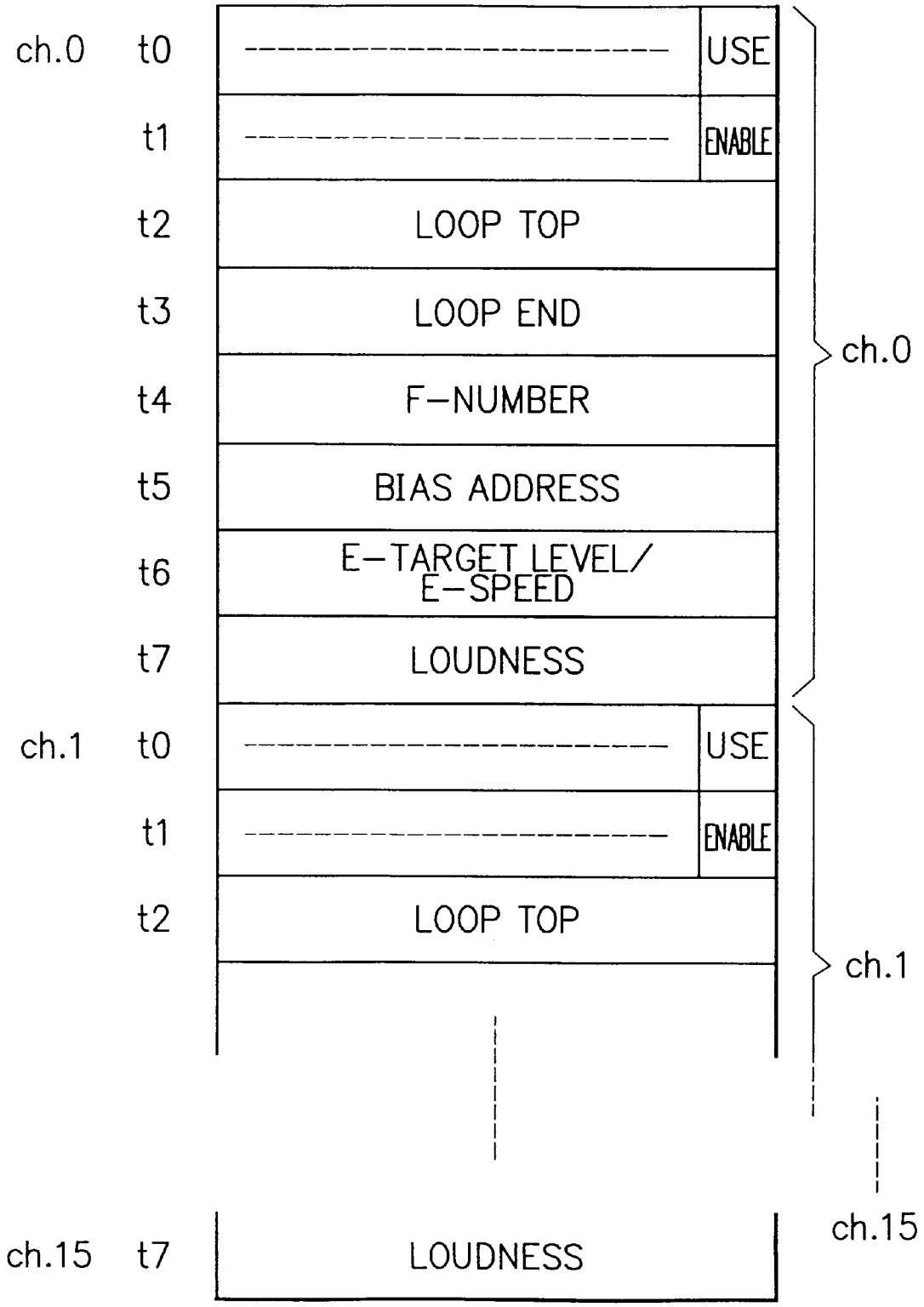
FIG. 3 is a view for explaining the memory format of an assignment memory in the electronic musical instrument.

The assignment memory 100 has eight addresses corresponding to the above-mentioned timing signals t0 to t7 in each of channels ch.0 to ch.15 to store parameters or various information for tone generation channels, as shown in, e.g., FIG. 3.

USE information indicating whether that channel is a used or unused channel is stored at an address corresponding to the timing signal t0, and enable information is stored at an address corresponding to the timing signal t1.

Loop top information is stored at an address corresponding to the timing signal t2; loop end information at an address corresponding to the timing signal t3; frequency number (to be referred to as an F-number hereinafter) information at an address corresponding to the timing signal t4; bias address information at an address corresponding to the timing signal t5; envelope target value (to be referred to as an E-target value hereinafter) /envelope speed (to be referred to as an E-speed hereinafter) information at an address corresponding to the timing signal t6; and loudness information at an address corresponding to the timing signal t7.

Various kinds of information (control data) described above in units of channels are stored by the host CPU 30, and are read out by the wave table address generator 200 in accordance with the above-mentioned signal Dadr generated by the addressing circuit 101.

The USE information stored at an address corresponding to the timing signal t0 is the one for generating the above-mentioned signal USE. The USE information of a channel assigned upon key depression is set at "1", and is reset to "0" when the envelope memory 400 confirms envelope release of that channel after key release.

Note that various kinds of information stored in the assignment memory 100 will be described in detail later.

In this embodiment, various kinds of information are allocated at addresses corresponding to the timing signals t0 to t7, but the present invention is not limited to such specific allocation.

The addressing circuit 101 for generating the above-mentioned signal Dadr and the power saving means 102 will be described in detail below.

Figure 4:
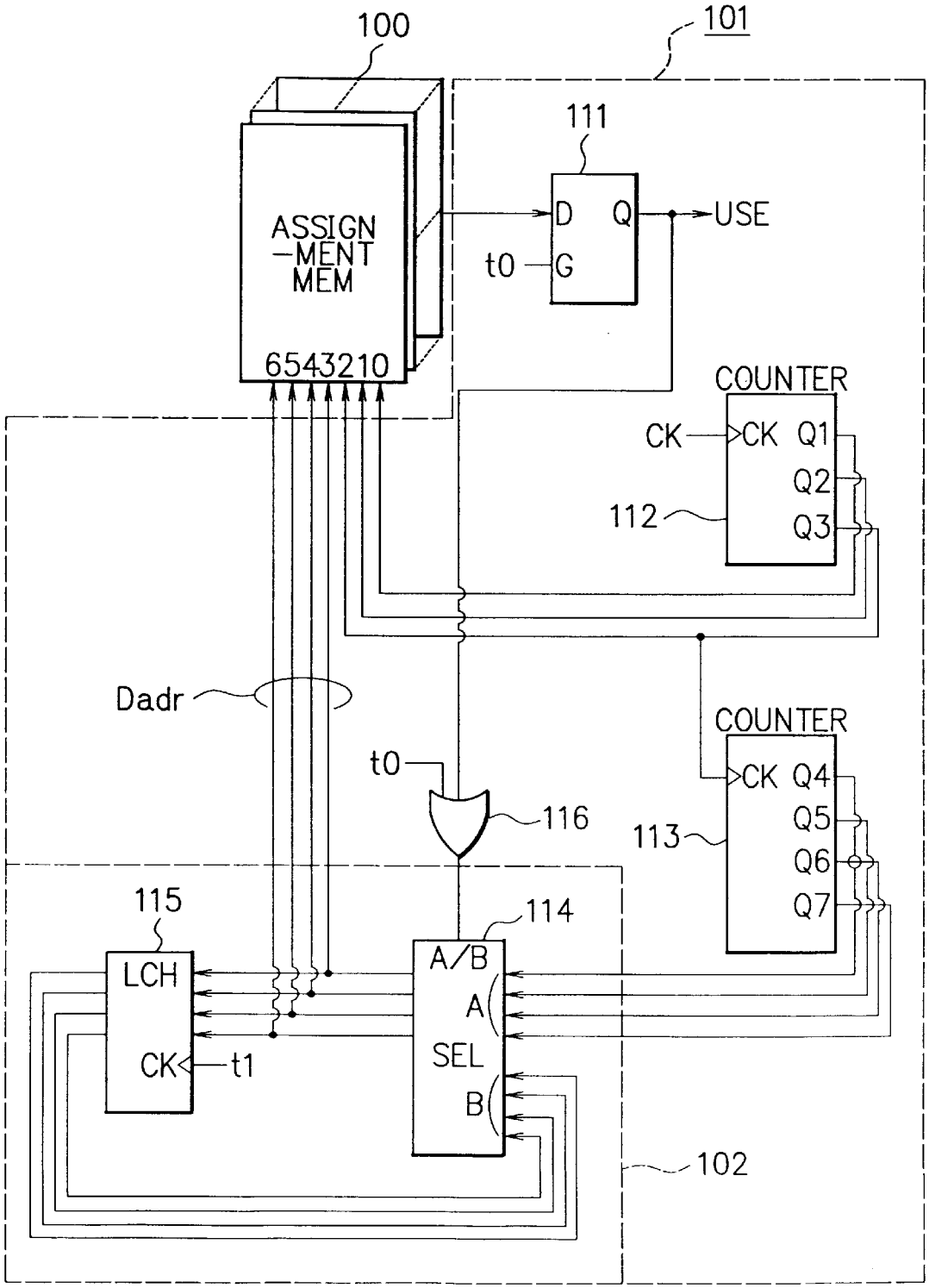
FIG. 4 is a block diagram showing the arrangement of an addressing circuit for the assignment memory in the electronic musical instrument.

As shown in, e.g., FIG. 4, the addressing circuit 101 and power saving means 102 comprise a latch circuit 111 which receives USE information of each channel of the assignment memory 100, a selector 114 which receives the output from the latch circuit 111 via an OR gate 116, a latch circuit 115 which receives the output from the selector 114, a counter 112, and a counter 113 which receives the output from the counter 112. The latch circuit 111 time-divisionally outputs the USE information of the respective channels.

The outputs from the counter 112 and selector 114 are also supplied to the assignment memory 100, and the outputs from the counter 113 and latch circuit 115 are supplied to the selector 114.

The latch circuit 111 and OR gate 116 receive the timing signal t0 shown in FIG. 2, and the latch circuit 115 receives the timing signal t1 shown in FIG. 2.

The power saving means 102 is controlled by the selector 114 and latch circuit 115 to output the output address information of the immediately preceding used tone generation channel when the tone generation channel is an unused one. In other words, the address data remains unchanged regardless of time-division operation.

More specifically, in the addressing circuit 101, the latch circuit 111 is a gate type latch circuit, latches the USE information in the assignment memory 100 at the trailing edge timing of the timing signal t0, and supplies it to the selector 114 via the OR gate 116.

At this time, the counter 112 supplies a count value according to a clock signal ck to the assignment memory 100 and the counter 113.

The counter 113 supplies a count value according to the count value from the counter 112 to a terminal A of the selector 114.

When the output from the OR gate 116 is "1", i.e., when the USE information is "1" (used channel), the selector 114 selects the output from the counter 113 supplied at its terminal A, and supplies it to the assignment memory 100 and latch circuit 115. On the other hand, when the output from the OR gate 116 is "0", i.e., when the USE information is "0" (unused channel), the selector 114 selects the output from the latch circuit 115 supplied at its terminal B, and supplies it to the assignment memory 100 and the latch circuit 115.

The latch circuit 115 is a clock edge type latch circuit, latches the output from the selector 114 at the trailing edge timing of the timing signal t1, and supplies it to the terminal B of the selector 114.

With this arrangement, the latch circuit 115 always stores the address information of the latest used channel (in this case, channel ch.0 or ch.2). In case of an unused channel, the contents of this latch circuit 115, i.e., the address information of the immediately preceding used channel is supplied to the assignment memory 100 again.

In this way, in case of an unused channel, the assignment memory 100 does not output any information of that unused channel.

The wave table address generator 200 which operates by reading out various kinds of information stored in the above-mentioned assignment memory 100 will be explained in detail below.

Figure 5:
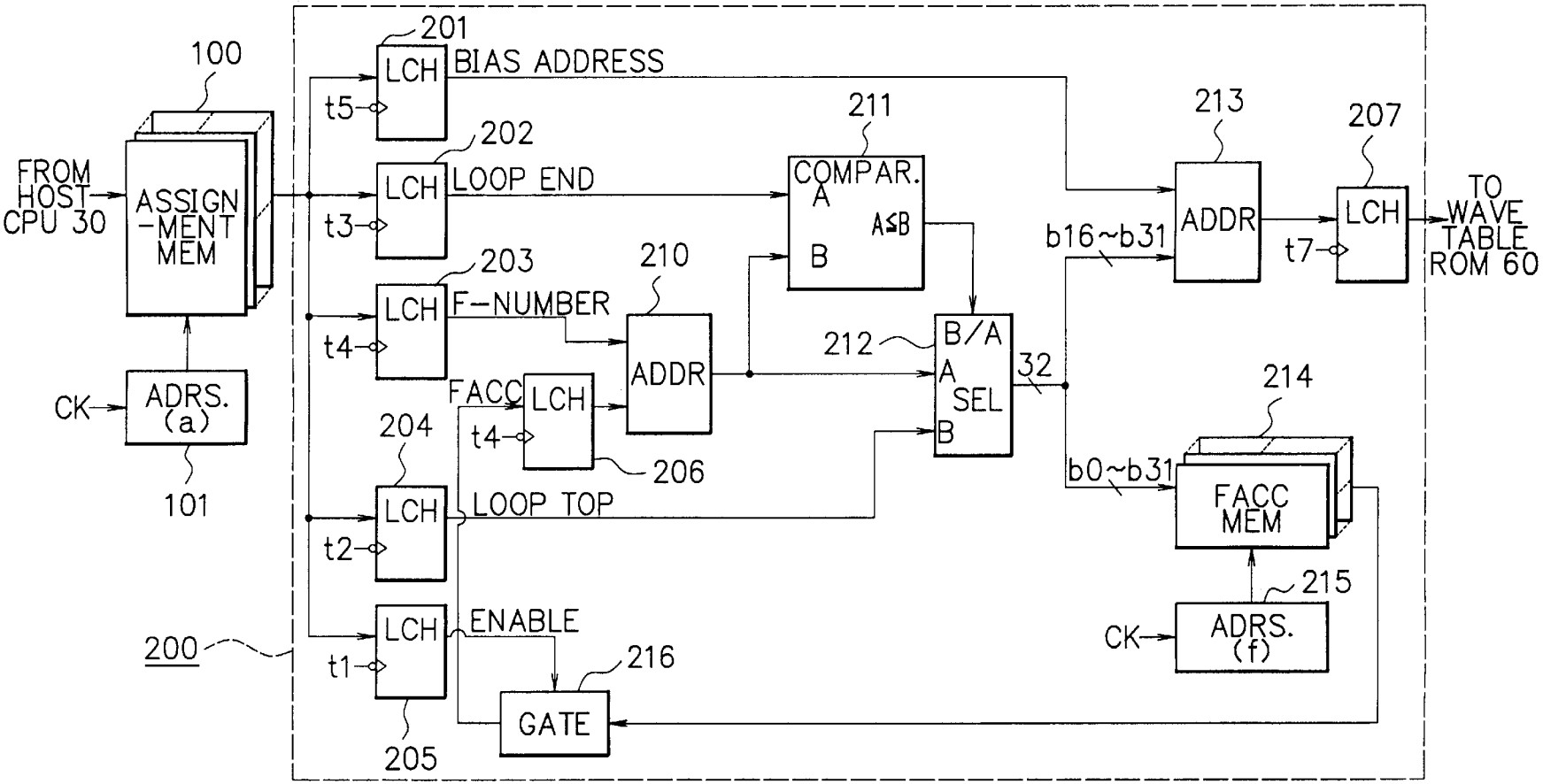
FIG. 5 is a block diagram showing the arrangement of a wave table address generator in the electronic musical instrument.

As shown in, e.g., FIG. 5, the wave table address generator 200 comprises latch circuits 201 to 206 which respectively receive information read out from the assignment memory 100, an adder 210 which receives the outputs from the latches 203 and 206, a comparator 211 which receives the outputs from the latch circuit 202 and adder 210, a selector 212 which receives the outputs from the latch circuit 204, adder 210, and comparator 211, an adder 213 which receives the outputs from the latch circuit 201 and selector 212, a latch circuit 207 which receives the output from the adder 213, an FACC memory 214 which receives the output from the selector 212, and a gate 216 which receives the output from the FACC memory 214. The output from the latch circuit 207 is supplied to the wave table 60 as the output of the wave table address generator 200.

The gate 216 is controlled by the output from the latch circuit 205, and the output from the gate 216 is supplied to the latch circuit 206.

Furthermore, the contents of the FACC memory 214 are read out in accordance with the output from an addressing circuit 215.

The latch circuits 201 to 207 respectively receive the timing signals t1 to t7 shown n FIG. 2, and make up pipelines.

For example, when the wave table address generator 200 performs an arithmetic operation for ch.0 as an used channel, the latch circuit 201 latches a bias address read out from the assignment memory 100 at the trailing edge timing of the timing signal t5, and supplies it to the adder 213.

The bias address information is a value indicating the write start address of a waveform, the operation for which is currently underway, in the wave table 60, i.e., information indicating the start address of a tone color.

The latch circuit 203 latches non-integer F-number information read out from the assignment memory 100 in response to the timing signal t4, and supplies it to the adder 210.

The F-number information corresponds to one reading address interval for the wave table, and in other words is a value for generating frequency, and is accumulated by the adder 210.

The latch circuit 202 latches loop end information read out from the assignment memory 100 in response to the timing signal t3, and supplies it to the terminal A of the comparator 211. The latch circuit 204 latches loop top information read out from the assignment memory 100 in response to the timing signal t2, and supplies it to the terminal B of the selector 212.

Figure 6:
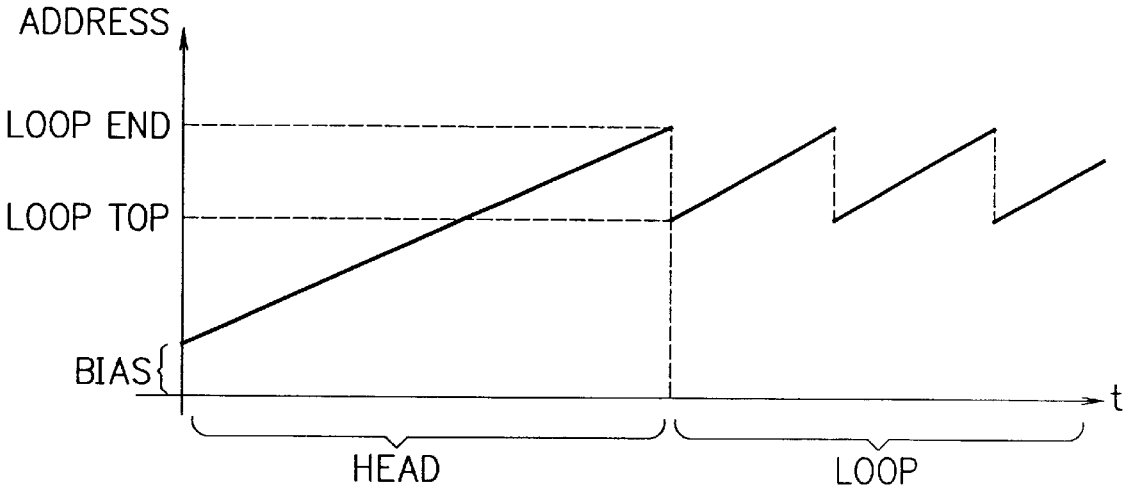
FIG. 6 is a graph for explaining the addresses generated by a Head+Loop method.

The loop end information and loop top information are those for setting the waveform read-out method as a Head+Loop method, i.e., information for generating an address shown in, e.g., FIG. 6.

Note that the wave table address generator 200 can simultaneously generate 16 different addresses to be read out by the Head+Loop method during one sampling period since it performs arithmetic operations for 16 channels.

The latch circuit 205 latches enable information read out from the assignment memory in response to the timing signal t1, and supplies it to the gate 216.

The enable information is temporarily set "OFF" by the host CPU 30 upon detecting a key ON event, and at that time, FACC (F-number accumulation result) data stored in the FACC memory 214 is cleared.

The latch circuit 206 latches FACC data from the gate 216 in response to the timing signal t4, and supplies it to the adder 210.

The adder 210 adds the F-number information from the latch circuit 203 and FACC data from the latch circuit 206, and supplies the sum as new FACC data to the terminal B of the comparator 211 and the terminal A of the selector 212.

The comparator 211 compares the loop end information supplied from the latch circuit 202 to its terminal A with the FACC data supplied from the adder 210 to its terminal B. When the loop end information is equal to or larger than the sum ($A \leqq B$), i.e., when the FACC data as the F-number accumulated value has reached the loop end, the comparator 211 supplies the result to the selector 212.

When it is determined based on the comparison result from the comparator 211 that the F-number accumulated value has reached the loop end, the selector 212 selects the loop top information from the latch circuit 204; otherwise, it selects the FACC data from the adder 210. The selector 212 then stores the selected loop top information or FACC data in the FACC memory 214, and supplies upper bit information (b16 to b31) as the integral part of that information to the adder 213.

The adder 213 adds the bias address information from the latch circuit 201 and the upper bit information (b16 to b31) from the selector 212, and supplies the sum to the latch circuit 207.

The latch circuit 207 latches the sum from the adder 213 in response to the timing signal t4, and outputs it as the read address of the wave table 60 via an output buffer (not shown).

The information stored in the FACC memory 214 is read out as FACC data by the gate 216, and is output to the latch circuit 206.

At this time, the gate 216 receives the enable information from the latch circuit 205. This enable information is temporarily set "OFF" by the host CPU 30 upon detecting a key ON event, and the FACC data is cleared at that time.

Since operation for used channel ch.2 is the same as that for used channel ch.0 described above, a detailed description thereof will be omitted.

On the other hand, when the wave table address generator 200 performs an arithmetic operation for ch.1 as an unused channel, the addressing circuit 101 supplies again address information of the used channel immediately preceding to channel ch.1, i.e., channel ch.0 described above, to the assignment memory 100 in the period of the timing signals t1 to t7. Hence, the assignment memory 100 does not output any information of channel ch.1 except for the period of the timing signal t0.

For this reason, the wave table address generator 200 holds the information of used channel ch.0 immediately preceding to unused channel ch.1.

Note that operations for unused channels ch.3 to ch.15 are the same as that for unused channel ch.1 described above, and a detailed description thereof will be omitted.

Hence, in the time slots of unused channels ch.1 and ch.3 to ch.15, the individual circuits of the wave table address generator 200 keep holding identical values, and CMOS elements that make up the circuits are not switched.

With this arrangement, since the read address of the wave table 60 is left unchanged, the output of the wave table 60 need not be switched.

The envelope generator 300 will be described in detail below.

Figure 7:
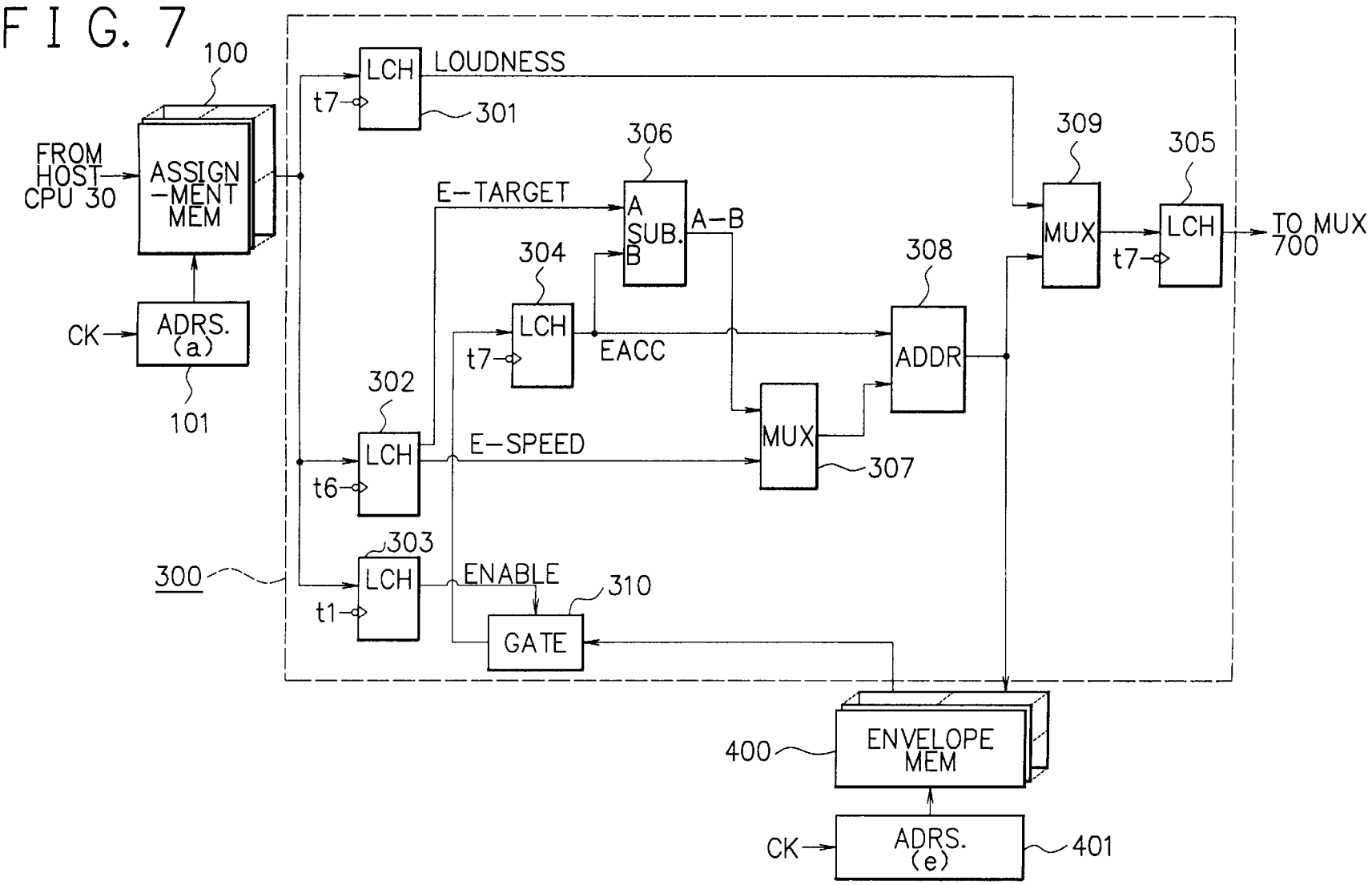
FIG. 7 is a block diagram showing the arrangement of an envelope generator in the electronic musical instrument.

As shown in, e.g., FIG. 7, the envelope generator 300 comprises latch circuits 301 and 302 which respectively receive information read out from the assignment memory 100, a multiplier 309 which receives the output from the latch circuit 301, a subtracter 306 and multiplier 307 which receive the output from the latch circuit 302, a gate 310 which receives the outputs from a latch circuit 303 and envelope memory 400, a latch circuit 304 which receives the output from the gate 310, an adder 308 which receives the outputs from a latch circuit 304 and the multiplier 307, and a latch circuit 305 which receives the output from the multiplier 309. The output from the latch circuit 305 is output as that of the envelope generator 300 to the multiplier 700.

The output from the latch circuit 304 is also supplied to the subtracter 306, and the output from the subtracter 306 is also supplied to the multiplier 307.

Furthermore, the output from the adder 308 is supplied to the multiplier 309 and envelope memory 400.

The latch circuits 301, 302, 303, 304, and 305 respectively receive the timing signals t7, t6, t1, t7, and t7 shown in FIG. 2.

The above-mentioned envelope generator 300 makes an envelope gradually approach the E-target value by:

$$EACC=(E\text{-target value}-EACC)\times E\text{-speed}+EACC$$

where EACC is the envelope accumulated value.

That is, when the envelope generator 300 performs an arithmetic operation for ch.0 as a used channel, the latch circuit 301 latches loudness information read out from the assignment memory 100 at the trailing edge timing of the timing signal t7, and supplies it to the multiplier 309.

The loudness information is a parameter for controlling the envelope value as a whole, which parameter is multiplied by EACC data by the multiplier 309 to output the product.

The latch circuit 302 latches E-target value/E-speed information read out from the assignment memory 100 in response to the timing signal t6, supplies E-target value information to a terminal A of the subtracter 306, and supplies E-speed information to the multiplier 307.

The latch circuit 303 latches enable information read out from the assignment memory 100 in response to the timing signal t1, and supplies it to the gate 110.

This enable information is temporarily set "OFF" by the host CPU 30 upon detecting a key ON event, and EACC (envelope accumulated value) data to be supplied to the gate 310 is cleared at that time.

The latch circuit 304 latches EACC data from the gate 310 in response to the timing signal t7, and supplies it to a terminal B of the subtracter 306 and the adder 308.

The subtracter 306 subtracts the EACC data supplied from the latch circuit 304 to its terminal B from the E-target value information supplied from the latch circuit 302 to its terminal A (E-target value−EACC).

Hence, the subtracter 306 can obtain the difference between the EACC data and the E-target value.

The multiplier 307 multiplies the difference from the subtracter 306 by the E-speed information from the latch circuit 302, i.e., a rate used when the EACC data reaches the E-target value ((E-target value−EACC)×E-speed), and supplies the product to the adder 308.

The adder 308 adds the product from the multiplier 307 and the EACC data from the latch circuit 304, i.e., the previous EACC data ((E-target value−EACC)×E-speed+EACC), and supplies the sum as the current EACC data to the multiplier 309 and envelope memory 400.

The multiplier 309 multiplies the EACC data from the adder 308 by the loudness information from the latch circuit 301, and supplies the product to the latch circuit 305.

The latch circuit 305 latches the product from the multiplier 309 in response to the timing signal t7.

The latch circuit 305 supplies the latched product as the output envelope value of the envelope generator 300 to the multiplier 700.

Since operation for used channel ch.2 is the same as that for used channel ch.0 described above, a detailed description thereof will be omitted.

On the other hand, when the envelope generator 300 performs an arithmetic operation for ch.1 as an unused channel, since the addressing circuit 101 supplies again address information of the used channel immediately preceding to channel ch.1, i.e., channel ch.0 described above to the assignment memory 100 during the period of the timing signals t1 to t7, as in the above-mentioned wave table address generator 200, the assignment memory 100 does not output any information of channel ch.1 except for the period of the timing signal t0.

For this reason, the envelope generator 300 holds information of used channel ch.0 immediately before unused channel ch.1.

Note that operations for unused channels ch.3 to ch.15 are the same as that for unused channel ch.1 described above, and a detailed description thereof will be omitted.

Hence, in the time slots of unused channels ch.1 and ch.3 to ch.15, the individual circuits of the envelope generator 300 keep holding identical values, and CMOS elements that make up the circuits are not switched.

With this arrangement, since the read address of the wave table 60 is left unchanged, the output of the wave table 60 need not be switched.

The adder/accumulator 500 will be described in detail below.

Figure 8:
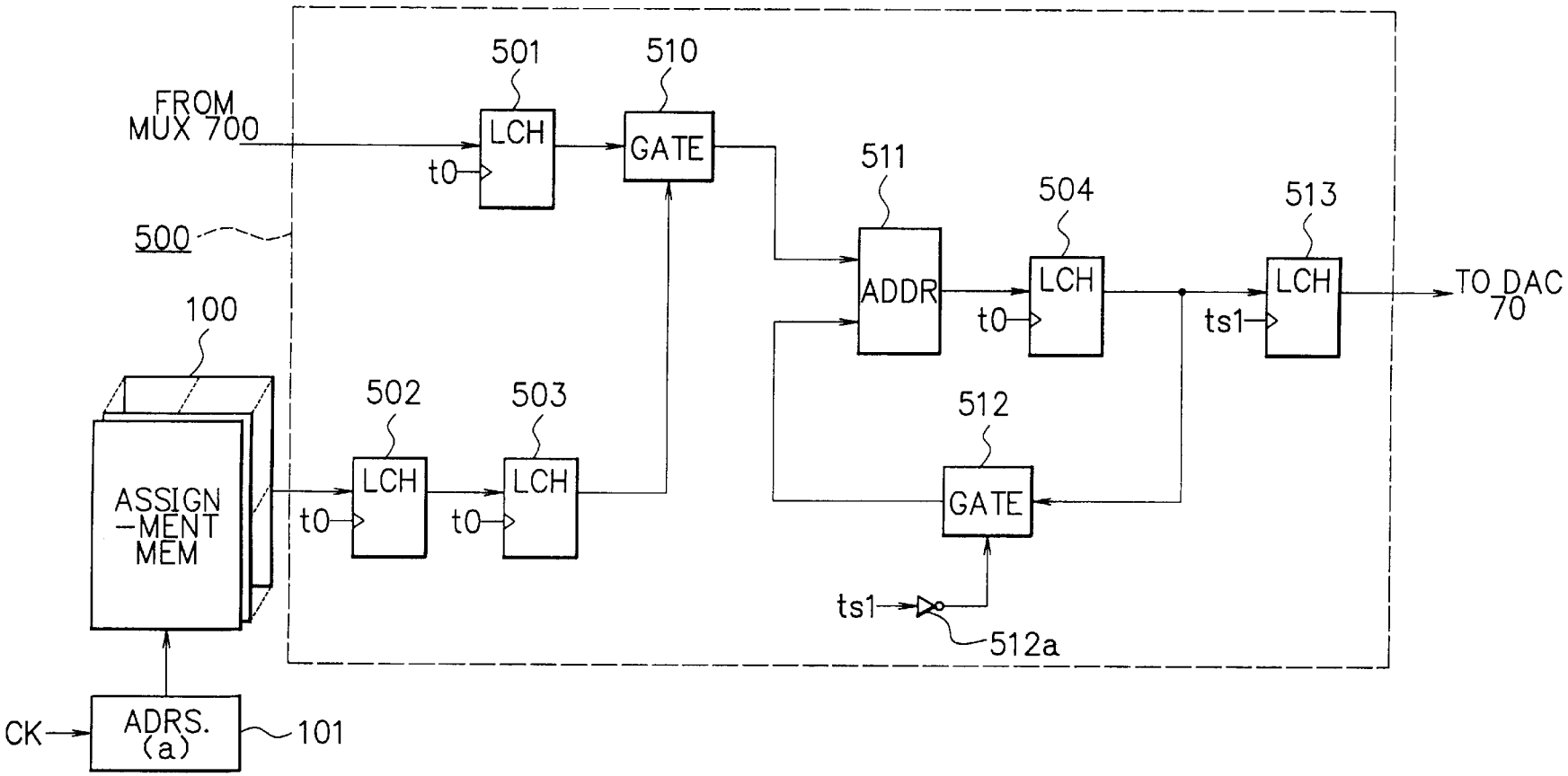
FIG. 8 is a block diagram showing the arrangement of an adder/accumulator of waveform data in the electronic musical instrument.

As shown in, e.g., FIG. 8, the adder/accumulator 500 comprises a latch circuit 501 which receives the product from the multiplier 700, a latch circuit 502 which receives information read out from the assignment memory 100, a latch circuit 503 which receives the output from the latch circuit 502, a gate 510 which receives the outputs from the latch circuits 501 and 503, an adder 511 which receives the output from the gate 510, a latch circuit 504 which receives the output from the adder 511, and a latch circuit 513 and gate 512 which respectively receive the output from the latch circuit 504. The output from the latch circuit 513 is output as that of the adder/accumulator 500, i.e., the wave generator 50, to the DAC 70.

The output from the gate 512 is supplied to the adder 511.

The latch circuits 501 to 504 receive the timing signal t0 shown in FIG. 2, and the latch circuit 513 receives the timing signal ts1 of channel ch.1 shown in FIG. 2. Also, the gate 512 receives the timing signal ts1 via an inverter 512*a*.

Since the timing signal t0 is output all the time independently of the used or unused status of channels, as described above, the latch circuits 501 to 504 always receive the timing signal t0 independently of the used or unused status of channels. Also, since the timing signal ts1 is always output independently of the used or unused status of channels, the latch circuit 513 and gate 512 always receive the timing signal ts1 independently of the used or unused status of channels.

The above-mentioned adder/accumulator 500 accumulates music tone data (sample point values) for 16 channels, which are generated time-divisionally.

As described above, when the signal USE is "1", i.e., when the channel of interest is a used channel, the wave table address generator 200 reads out waveform data from the wave table 60, and the envelope generator 300 generates an envelope. The multiplier 700 multiplies the readout waveform data and generated envelope.

On the other hand, when the signal USE is "0", i.e., when the channel of interest is an unused channel, since the wave table address generator 200 and envelope generator 300 hold previous values, the multiplier 700 outputs the previous product. Hence, in this case, the product need be cleared (gated).

For this purpose, the adder/accumulator 500 gates data from the multiplier 700 input at the timing of an unused channel.

More specifically, as described above, since the envelope is supplied from the envelope generator 300 to the multiplier 700 at the timing of the timing signal t7, the product is also supplied from the multiplier 700 to the latch circuit 501 at the timing of the timing signal t7.

The latch circuit 501 re-latches data at the timing signal t0 next to the timing signal t7 in consideration of easy timing control, and latches the product from the multiplier 700 in response to the timing signal t0 and supplies it to the gate 510.

On the other hand, the latch circuits 502 and 503 adjust any delay produced by arithmetic operations of the wave table address generator 200 and envelope generator 300 to that for one channel.

Hence, the latch circuit 502 latches the output from the assignment memory 100 in response to the timing signal t0, and supplies it to the next latch circuit 503. The latch circuit 503 latches the output from the latch circuit 502 in response to the timing signal t0, and supplies it as a control signal to the gate 510.

In accordance with the control signal from the latch circuit 503, the gate 510 directly supplies the data from the latch circuit 501 to the adder 511 in case of the used channel; or clears data from the latch circuit 501 and supplies it to the adder 511 in case of an unused channel.

The adder 511 adds the outputs from the gate 510 and gate 512, and supplies the sum to the latch circuit 504. The latch circuit 504 latches the sum from the adder 511 in response to the timing signal t0, and supplies it to the adder 511 via the gate 512. Such accumulation is done during the period of channels ch.0 to ch.15.

At this time, the gate 512 clears data (accumulated result) from the latch circuit 504 at the time of beginning accumulation for 16 channels in response to the timing signal ts1 supplied via the inverter 512*a*.

As described above, the data supplied from the latch circuits 501 to 503 to the adder 511 are those delayed by one channel. Hence, at the timing of channel ch.1, the adder 511 receives data for channel ch.0. For this reason, the clear timing of the contents (accumulated result) of the latch circuit 504 is defined by the timing of the timing signal ts1.

The accumulated result for 16 channels obtained in this way is supplied to the latch circuit 513. The latch circuit 513 latches the accumulated result for 16 channels in response to the timing signal ts1, and supplies it to the DAC 70 as the output of the adder/accumulator 500.

Figure 9:
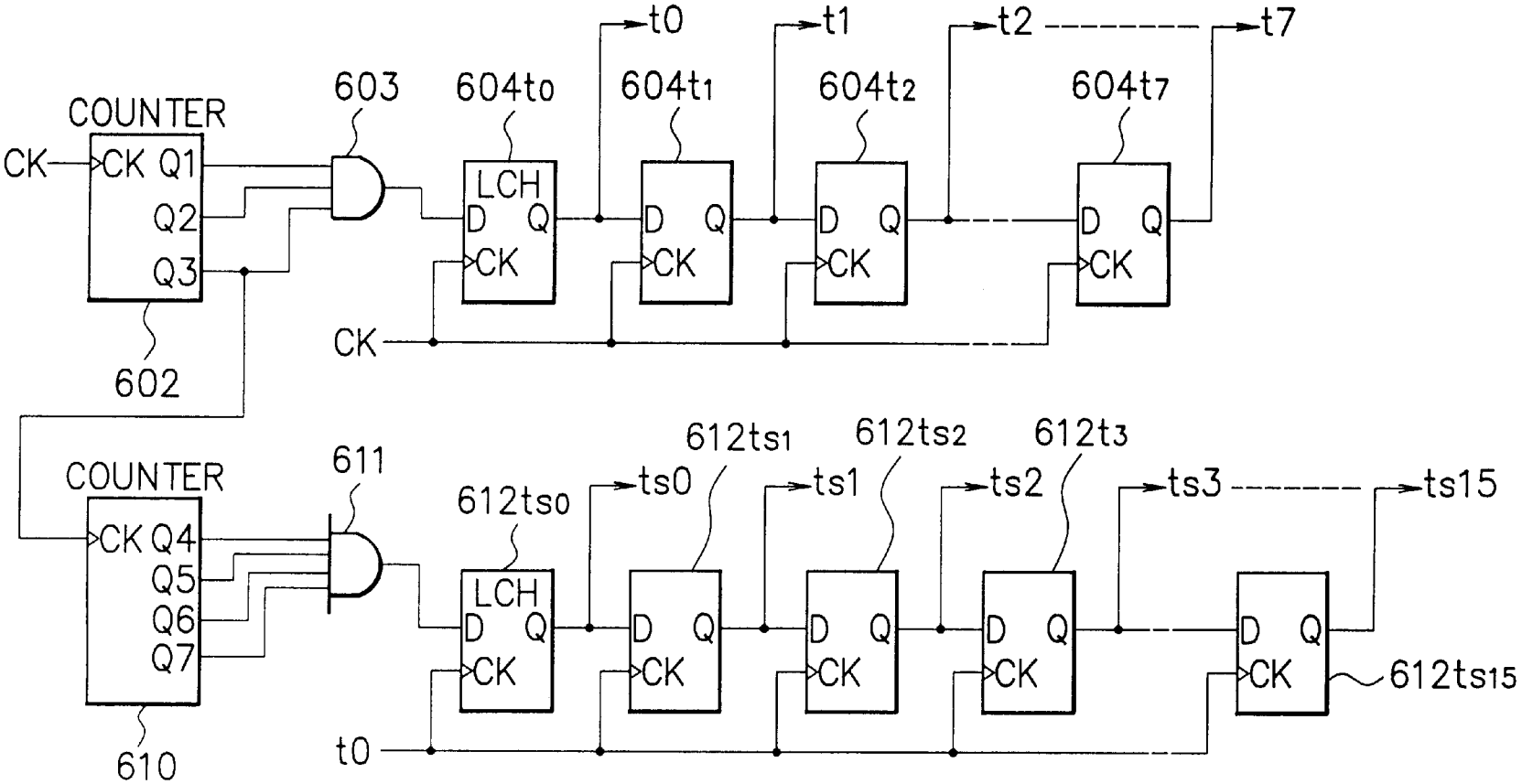
FIG. 9 is a block diagram showing the arrangement of a system clock generator.

FIG. 9 is a block diagram showing the arrangement of the system clock generator 600. The details of the system clock generator will be described later in the third embodiment.

As described above, in the first embodiment, since the addressing circuit 110 outputs again address information of the used channel immediately before an unused channel to the assignment memory 100 in a time slot of the unused channel, information of that unused channel is inhibited from being read out from the assignment memory 100. In this fashion, the number of times of switching of CMOS elements of the circuits arranged after the assignment memory 100 can be reduced as much as possible, thus attaining total power savings. Especially, since a versatile LSI is normally constituted by CMOS elements that consume large electric power upon switching irrespective of Low/High output level, the number of times of switching of the circuits is reduced as much as possible, thus attaining further power savings. As a result of power savings, the radiation amount of electromagnetic waves can be relatively reduced.

Second Embodiment

The second embodiment will be described below.

Figure 10:
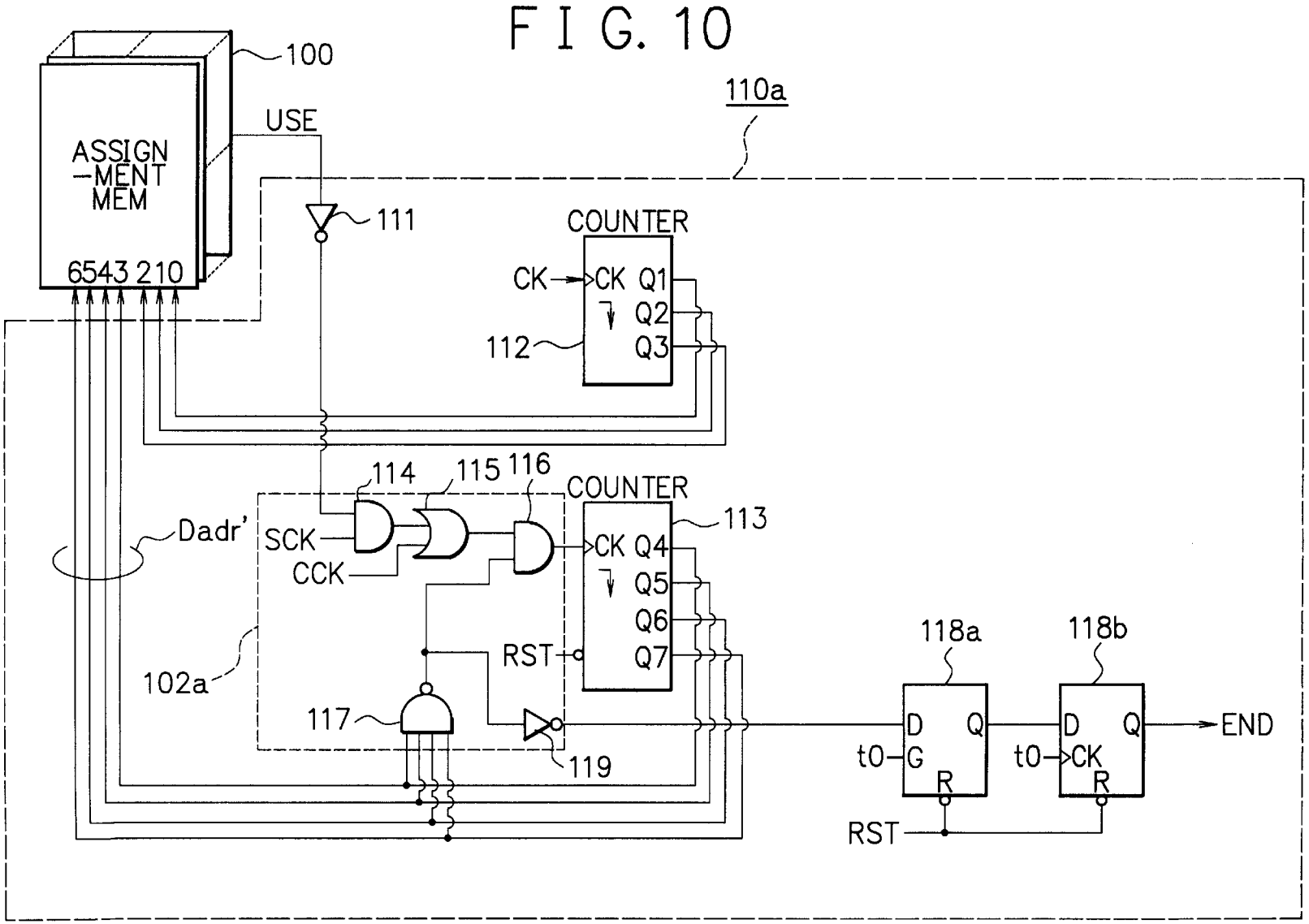
FIG. 10 is a block diagram showing the arrangement of an addressing circuit in an electronic musical instrument to which an electronic music tone generator according to the present invention is applied in the second embodiment.

In the first embodiment described above, since the addressing circuit 110 generates the signal Dadr shown in FIG. 2, information of an unused channel is inhibited from being read out from the assignment memory 100. In contrast to this, in the second embodiment, an addressing circuit 110*a* shown in FIG. 10 is arranged in place of the addressing circuit 110 to generate a signal Dadr', so that information of a used channel or information of the last channel alone is continuously read out from the assignment memory 100. Note that the portion bounded by the dotted line in the addressing circuit 110*a* corresponds to a power saving means 102*a*.

Note that the circuits other than the addressing circuit 110*a* and the signal Dadr' generated by the addressing circuit 110*a* in the second embodiment are the same as those in the first embodiment, and a detailed description thereof will be omitted. In the following description, only the difference from the first embodiment will be explained.

In the signal Dadr' generated by the addressing circuit 110*a*, address information of each used channel (channels ch.0 and ch.2) is set preferentially, and address information of the last channel (channel ch.15) is used as those of subsequent unused channels (channels ch.1 and ch.3 to ch.15).

Figure 13:
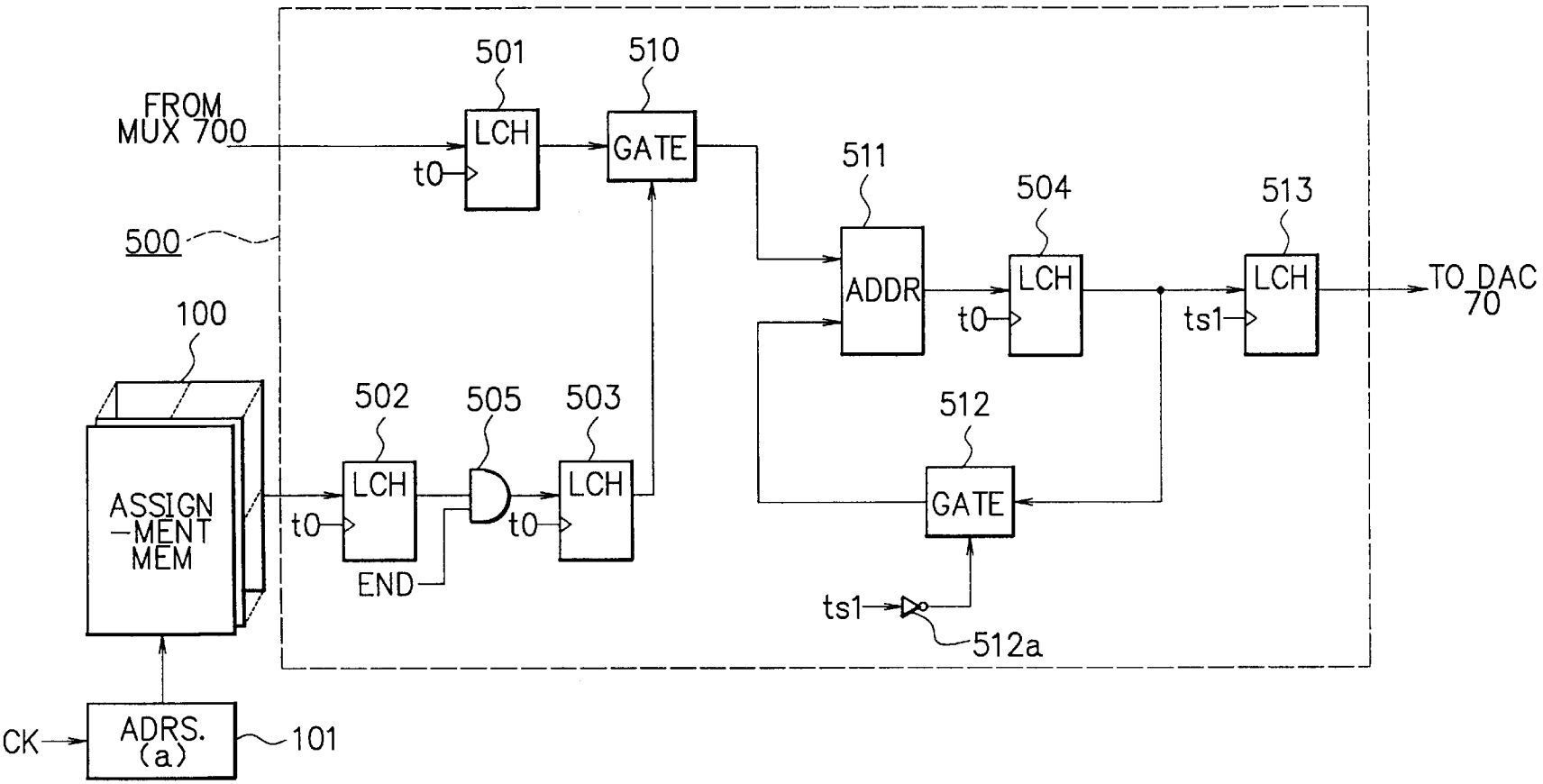
FIG. 13 is a block diagram showing the arrangement of an adder/accumulator in the electronic musical instrument.

In order to generate the signal Dadr' described above, a timing signal (shift clock) SCK for searching tone generation channels ch.0 to ch.15, a reset signal RST, and timing signal (channel clock) CCK for reading out data for the next channel are used, as shown in, e.g., FIG. 13.

The reset signal RST generates one pulse per 16 channels, and the timing signal CCK generates pulses in units of channels.

As for the timing signal CCK, since the reset signal RST also generates a pulse in channel ch.0, a counter 113 (to be described later) in the addressing circuit 110*a* is set in the reset state during this interval.

These signals SCK, RST, and CCK are supplied to the addressing circuit 110*a*, and are also supplied to an addressing circuit 401 in the envelope memory 400 an an addressing circuit 215 for the FACC memory 214 in the wave table address generator 200 although not shown.

As shown in FIG. 10 above, the addressing circuit 110*a* comprises a NOT gate 111 which receives the output from the assignment memory 100, an AND gate 114 which receives the output from the NOT gate 111, an OR gate 115 which receives the output from the AND gate 114, an AND gate 116 which receives the output from the OR gate 115, the counter 113 which receives the output from the AND gate 116, a NAND gate 117 which receives the output from the counter 113, a NOT gate 119 which receives the output from the NAND gate 117, a gate 118*a* which receives the output from the NOT gate 119, and a gate 118*b* which received the output from the gate 118*a*. The output from the counter 113 is also supplied to the assignment memory 100, and the output from the NAND gate 117 is also supplied to the AND gate 116.

These AND gate 114, OR gate 115, AND gate 116, and NAND gate 117 constitute the power saving means 102*a*.

The counter 112 receives a clock signal ck, and the gates 118*a* and 118*b* receive the timing signal t0.

Furthermore, the AND gate 114 receives the above-mentioned timing signal SCK, the OR gate 115 receives the timing signal CCK, and the gates 118*a* and 118*b* receive the reset signal RST.

The gate 118*b* outputs a signal END, which is supplied to the adder/accumulator 500, as will be described in detail later.

In the above-mentioned addressing circuit 110*a*, the count value of the counter 112 is always supplied to the assignment memory 100.

When the counter 113 is reset by the reset signal RST, USE information of tone generation channel ch.0 is read out from the assignment memory 100 in accordance with the count value (t0) of the counter 112 in response to a "0" output from the counter 113.

During the interval of this reset signal RST, a timing signal CCK is also generated but is not counted up since the reset signal RST has higher priority.

On the other hand, since tone generation channel ch.0 is a used channel in this embodiment, USE information in the readout information is "1".

Hence, USE information of "1", i.e., a signal USE of "1" is supplied to the AND gate 114 via the NOT gate 111.

At this time, the AND gate 114 receives a timing signal SCK, but the timing signal SCK supplied to the AND gate 114 is disabled by the output (="0") from the NOT gate 111. As a result, the counter 113 does not count, and outputs a count value "0".

Therefore, various kinds of information of tone generation channel ch.0 are read out from the assignment memory 100 in accordance with the count values (t1 to t7) of the counter 112.

When a timing signal CCK is supplied to the OR gate 115 at the beginning of the next time slot-1, the count value of the counter 113 is counted up to "1", and USE information of tone generation channel ch.1 is read out from the assignment memory 100 in accordance with the count value (t0) of the counter 112.

Since this tone generation channel ch.1 is an unused channel in this embodiment, USE information in the readout information is "0".

Hence, USE information of "0", i.e., a signal USE of "0" is supplied to the AND gate 114 via the NOT gate 111.

Figure 12:
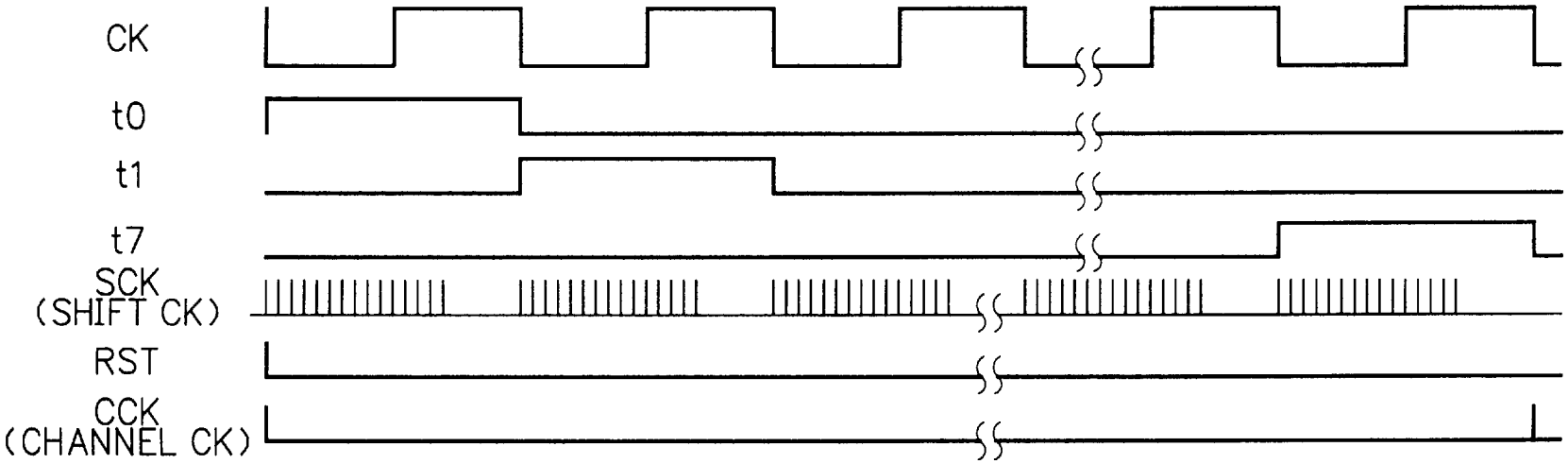
FIG. 12 is a timing chart showing the timing clocks of a timing signal SCK, reset signal RST, and timing signal CCK.

At this time, the AND gate 114 receives a timing signal SCK, but the timing signal SCK supplied to the AND gate 114 is enabled by the output (="1") from the NOT gate 111. The timing signal SCK consists of 15 shift clocks SHIFTCK each having a period sufficiently shorter than that of the clock pulse ck, as shown in FIG. 12. These shift clocks are counted up by the counter 113. In this case, since the signal USE becomes "1" in the next tone generation channel ch.2, the output from the NOT gate 111 changes to "0", and clock supply to the counter 113 is stopped. Hence, the count output Dadr' of the counter 113 becomes a value that indicates channel ch.2.

More specifically, in this case, no read of information for tone generation channel ch.1 is done from the assignment memory 100, and processing of the next tone generation channel ch.2 starts.

Since tone generation channel ch.2 is a used channel in this embodiment, various kinds of information of tone generation channel ch.2 are read out from the assignment memory 100 as in tone generation channel ch.0, and time slot-1 is used for operations of tone generation channel ch.2.

When the processing enters the next time slot-2, since a timing signal CCK is supplied to the OR gate 115, the count value of the counter 113 is counted up, and its signal Dadr' indicates channel ch.3. For this reason, USE information of tone generation channel ch.3 is read out. However, since tone generation channel ch.3 is an unused channel in this embodiment, various kinds of information of tone generation channel ch.3 are not read out from the assignment memory 100 as in tone generation channel ch.1 described above, and processing of the next tone generation channel ch.4 starts in response to a shift clock SCK.

When the processing has been completed up to tone generation channel ch.15, as described above, i.e., when the output from the counter 115 has reached "15" (Q4 to Q7 are all "1"s), information of tone generation channel ch.15 as the last channel is read out from the assignment memory 100 in response to that output. At this time, since the NAND gate 117 detects that the output from the counter 113 has become all "1"s, and generates an output "0", the count value of the counter 113 is stopped at "15".

Information read of this tone generation channel ch.15 is repeated during the remaining time period, i.e., in all the blank time slots (time slots for 14 channels in this embodiment).

Hence, since the assignment memory 100 continuously outputs only the information of used channels (channels ch.0 and ch.2), arithmetic operations of used channels are done in the wave table address generator 200 and envelope generator 300 ahead of time.

In the blank time slots, since the information of the last channel (channel ch.15) is repetitively output from the assignment memory 100, CMOS elements of the internal circuits of the wave table address generator 200 and envelope generator 300 are not switched, and the arithmetic operation results of the last channel are held during this interval.

The wave table address generator 200 and envelope generator 300 initially output the arithmetic operation results of tone generation channel ch.0, and then output those of tone generation channel ch.2. After that, these generators output the arithmetic operation results of tone generation channel ch.15 for 14 channels.

Hence, the adder/accumulator 500 arranged at the output side of the wave table address generator 200 and envelope generator 300 initially receives the arithmetic operation results of tone generation channel ch.0, and then receives those of tone generation channel ch.2. After that, the adder/accumulator 500 receives the arithmetic operation results of tone generation channel ch.15 for 14 channels.

For this reason, the adder/accumulator 500 must enable only the initially received arithmetic operation results of tone generation channel ch.15 and ignore the subsequently received arithmetic operation results of tone generation channel ch.15.

For this purpose, the internal arrangement of the adder/accumulator 500 is modified, as shown in, e.g., FIG. 13. That is, an AND gate 505 is arranged between the latch circuits 502 and 503, and receives the signal END obtained by the addressing circuit 110*a*.

Figure 11:
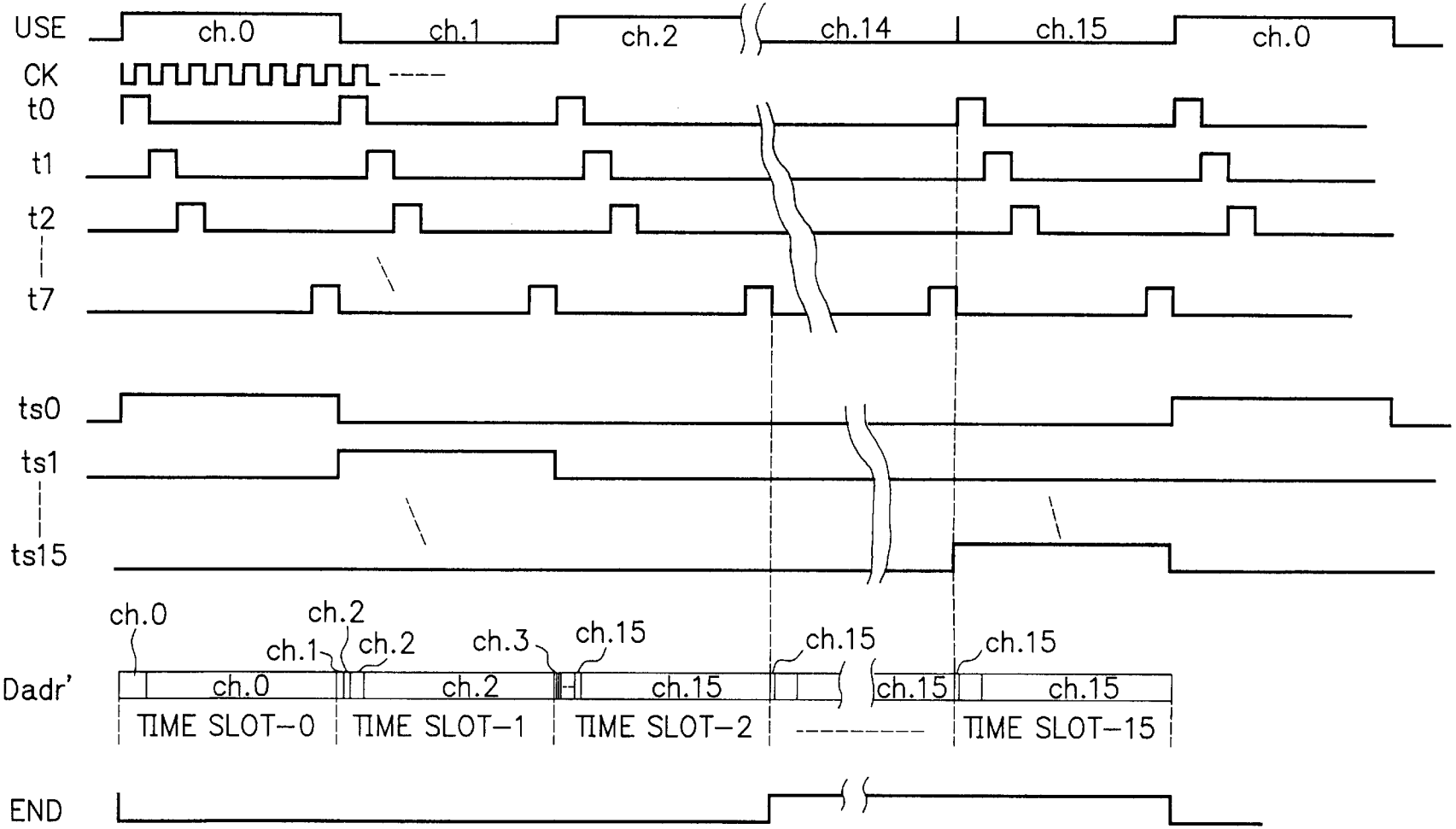
FIG. 11 is a timing chart showing the timing clocks of signals Dadr and END.

This signal END is the one shown in FIG. 11, indicates blank time slots except for that of the initial tone generation channel ch.15, and is generated by the gates 118*a* and 118*b* shown in FIG. 10.

With this arrangement, when the signal END is "1", the latch circuit 503 does not operate, and the adder/accumulator 500 accumulates the arithmetic operation results of tone generation channel ch.0, those of tone generation channel ch.2, and the initial arithmetic operation results of tone generation channel ch.15.

As described above, since the second embodiment can reduce the number of times of switching as well, total power savings can be attained as in the first embodiment described above.

Third Embodiment

The third embodiment of the present invention will be described below.

Figure 14:
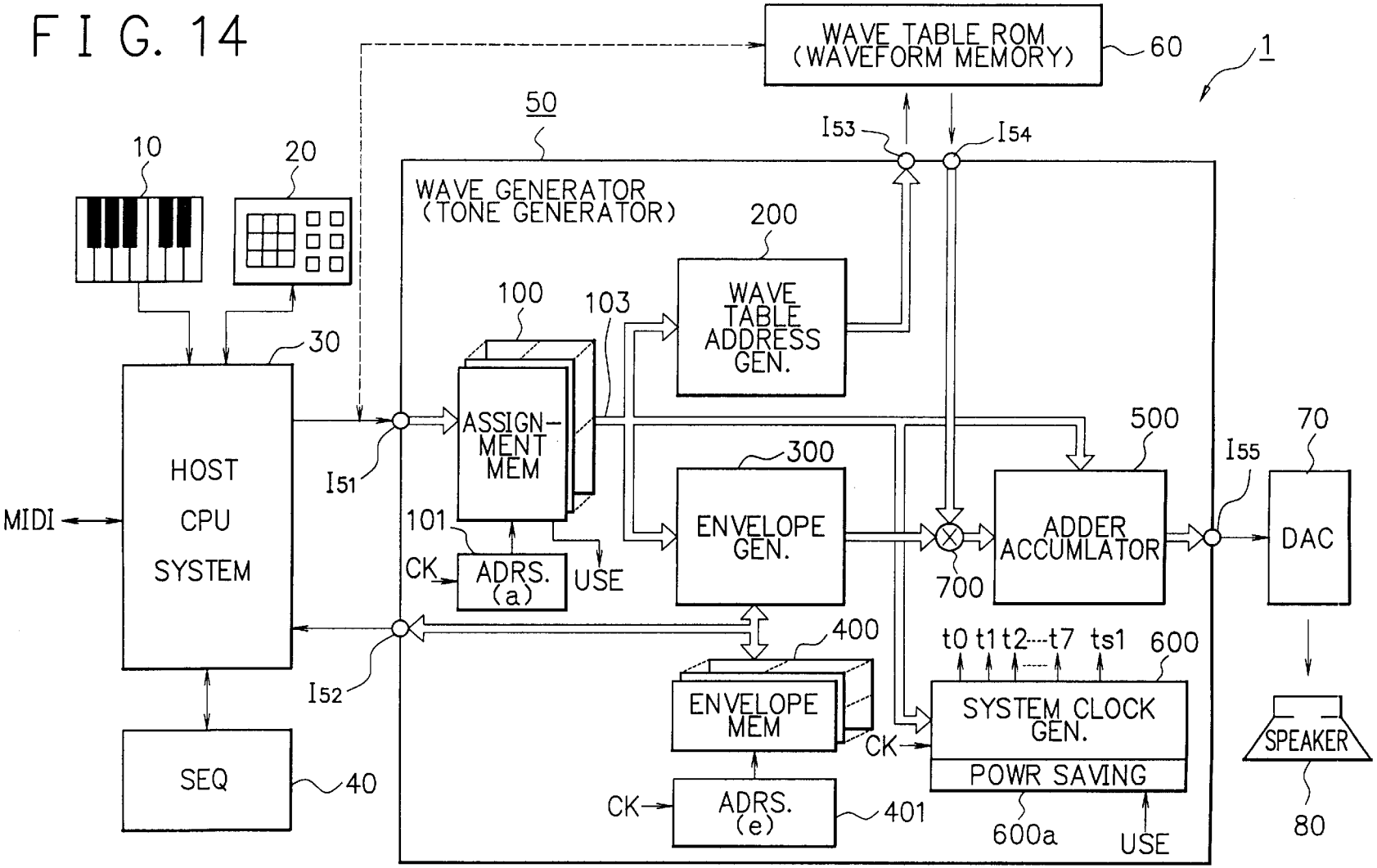
FIG. 14 is a block diagram showing the arrangement of an electronic musical instrument to which an electronic music tone generator according to the present invention is applied in the third embodiment.

FIG. 14 is a block diagram of an electronic musical instrument similar to that shown in FIG. 1, except that a power saving means 600*a* is added to the system block generator 600. Since other portions are the same as those in FIG. 1, a detailed description thereof will be omitted.

Figure 15:
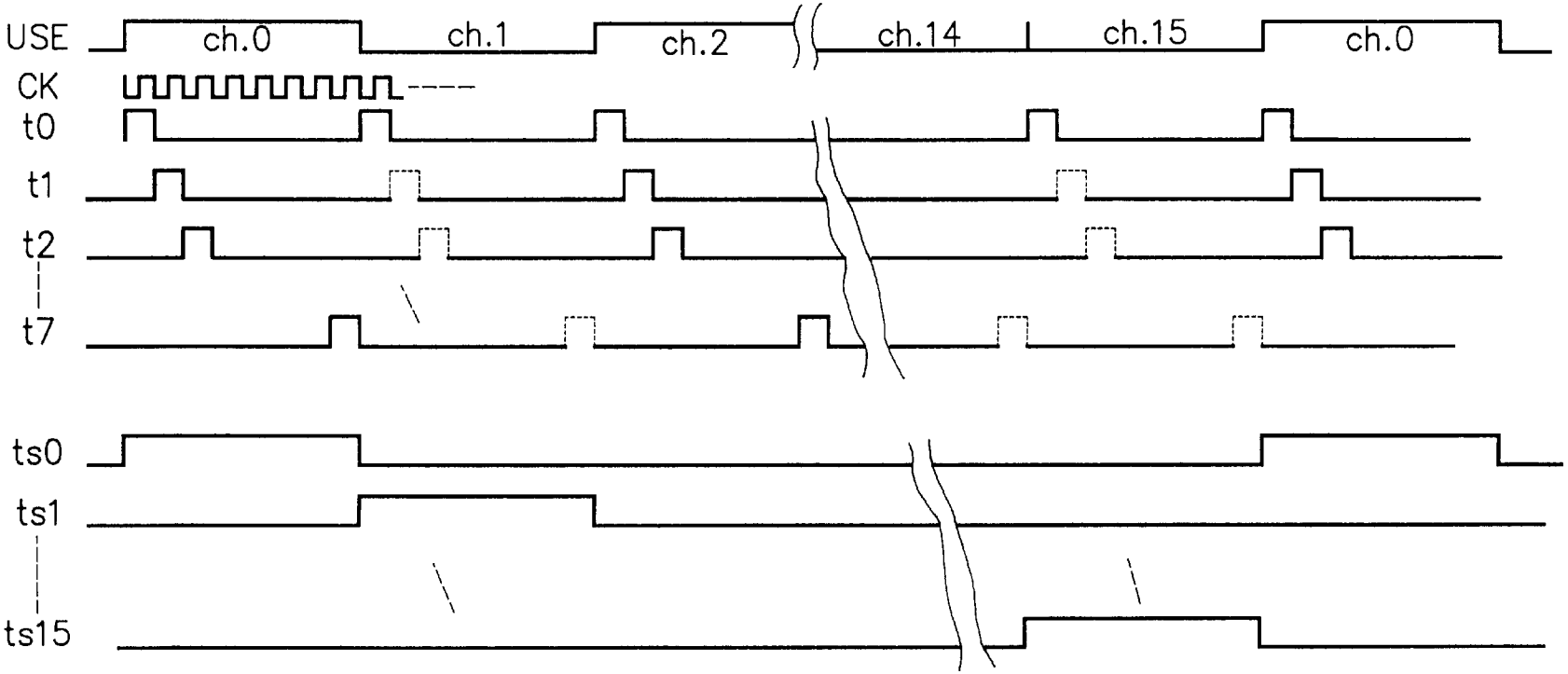
FIG. 15 is a timing chart showing the timing clocks of a wave generator in the electronic musical instrument in the third embodiment.

FIG. 15 is a timing chart showing the timing clocks in the wave generator 50. In FIG. 15, a signal USE, and timing signals t0 to t7 and ts0 to ts15 are generated by the system clock generator 600.

The signal USE is a time division signal (time division for 16 channels ch.0 to ch.15 in this embodiment), and is set at "1" when the channel of the allocated time slot is in use; or "0" when it is not in use. Hence, in FIG. 15, two channels ch.0 and ch.2 are used channels.

The timing signal t0 is always output irrespective of the value of the signal USE, and the signal USE of each time division channel is latched in response to this timing signal t0.

On the other hand, other timing signals t1 to t7 are not output when the signal USE is "0".

More specifically, in the wave generator 50, when the signal USE is "1", since it indicates a used channel, latch clocks for pipeline (to be described later) are generated using the timing signals t1 to t7; when the signal USE is "0", since it indicates an unused channel, latch clocks are inhibited from being generated, as indicated by the dotted lines in FIG. 15.

Hence, in the time slots of channels ch.1 and ch.3 to ch.15 as unused channels, latch clocks of the timing signals t1 to t7 are omitted.

The timing signals ts0 to ts15 respectively correspond to channels ch.0 to ch.15, and change to "1" when the corresponding channels are to be processed.

In this embodiment, the adder/accumulator 500 (to be described later) uses the timing signal ts1 alone.

Note that the system clock generator 600 for generating the above-mentioned signal USE, and timing signals t0 to t7 and ts0 to ts15 will be described in detail later.

Although the data format of the assignment memory 100, and the arrangements of the wave table address generator 200, envelope generator 300, and adder/accumulator 500 in FIG. 14 are the same as those shown in FIGS. 3, 5, 7, and 8, operation in the time slot of an unused channel is different.

When the wave table address generator 200 performs an arithmetic operation for ch.1 as an unused channel, latch clocks of the timing signals ti to t7 are not generated, as indicated by the dotted lines in FIG. 15.

For this reason, since the latch circuits 201 to 207 do not receive any latch clocks of the timing signals t1 to t7, they do not operate, i.e., the contents of the pipeline processing latches are not updated, and the value latched in the previous arithmetic operation processing of a used channel, e.g., that of used channel ch.0 described above, remains.

Since operations for unused channels ch.3 to ch.15 are the same as that of used channel ch.1 mentioned above, a detailed description thereof will be omitted.

Accordingly, in the time slots of unused channels ch.1 and ch.3 to ch.15, not only the latch circuits 201 to 207 but also the subsequent circuits (adder 210, comparator 211, selector 212, and adder 213) do not operate, and keep holding an identical value. As a result, CMOS elements that make up the circuits are not switched.

In this manner, since the read address of the wave table 60 is left unchanged, the output of the wave table 60 need not be switched, either.

Note that the assignment memory 100 and FACC memory 214 are accessed by the addressing circuits 101 and 215 irrespective of the used/unused status of channels.

When the envelope generator 300 performs arithmetic operation for ch.1 as an unused channel, latch clocks of the timing signals t1 to t7 are not generated, as indicated by the dotted lines in FIG. 15 as in the above-mentioned wave table address generator 200. For this reason, since the latch circuits 301 to 305 do not receive any latch clocks of the timing signals t7, t6, and t1, the latch circuits 301 to 305 do not operate, and the value latched in the previous arithmetic operation processing of a used channel, e.g., that of used channel ch.0 described above, remains.

Since operations for unused channels ch.3 to ch.15 are the same as that of used channel ch.1 mentioned above, a detailed description thereof will be omitted.

Hence, in the time slots of unused channels ch.1 and ch.3 to ch.15, not only the latch circuits 301 to 305 but also the subtracter 306, multiplier 307, adder 308, and multiplier 309 do not operate, and keep holding an identical value. As a result, CMOS elements that make up the circuits are not switched.

When the signal USE is "0" in the adder/accumulator 500, i.e., when the current channel is an unused channel, since the wave table address generator 200 and envelope generator 300 hold previous data, the multiplier 700 outputs the previous product. For this reason, in this case, the product must be cleared (gated) by the gate 510 (FIG. 8) as in the first embodiment.

In accordance with the control signal from the latch circuit 503, the gate 510 directly supplies the data from the latch circuit 501 to the adder 511 in case of a used channel; or clears data from the latch circuit 501 and supplies it to the adder 511 in case of an unused channel.

Figure 16:
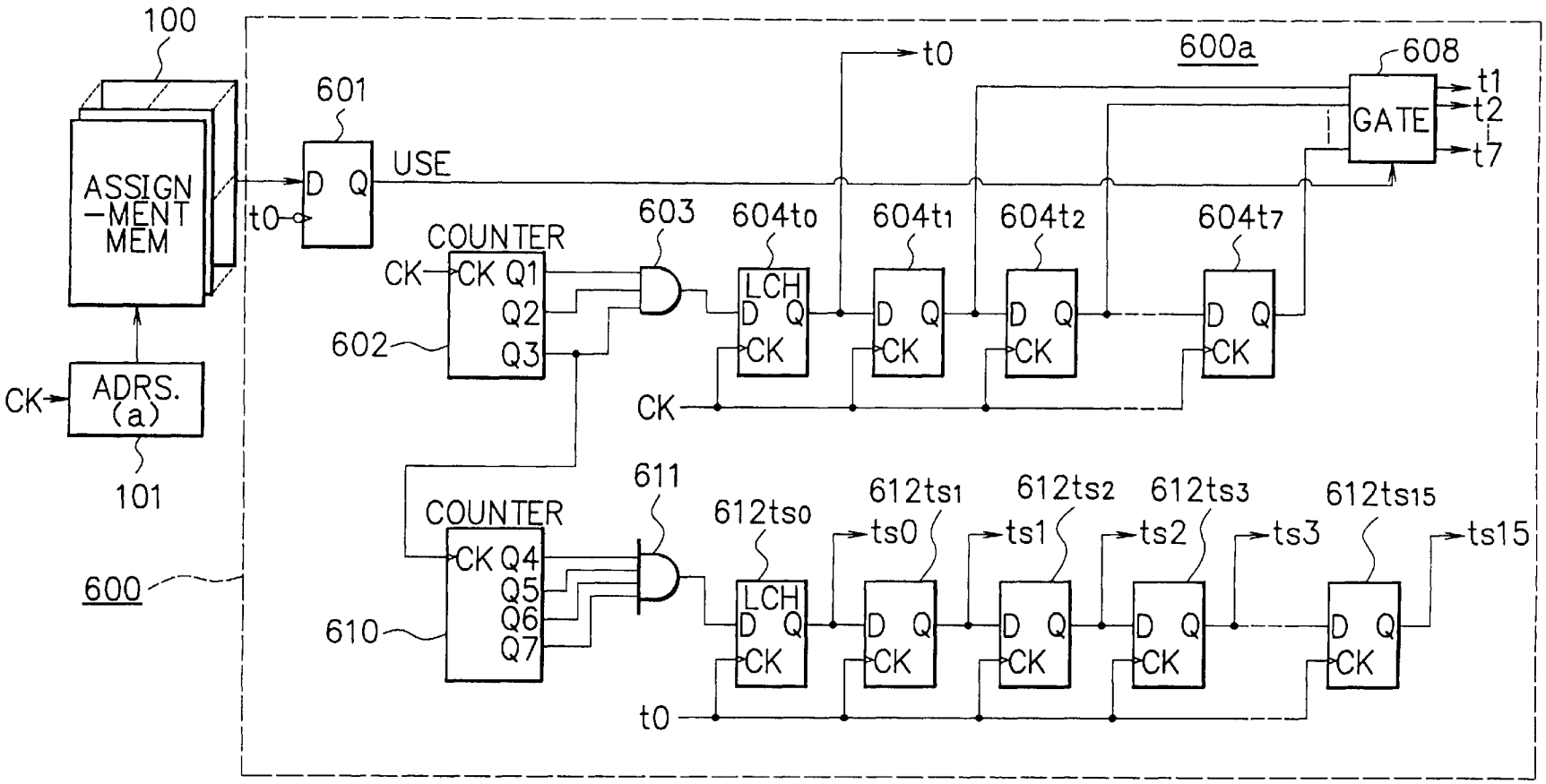
FIG. 16 is a block diagram showing the arrangement of a system clock generator.

As shown in, e.g., FIG. 16, the system clock generator 600 comprises a latch circuit 601 which receives information read out from the assignment memory 100, a counter 602, an AND gate 603 and counter 610 which respectively receive the output from the counter 602, an AND gate 611 which receives the output from the counter 610, latch circuits 604t0 to 604t7 which receive the output from the AND gate 603, a gate 608 which receives the outputs from the latch circuits 601 and 604t0 to 604t7, and latch circuits 612ts0 to 612ts15 which receive the output from the AND gate 611. The output from the latch circuit 604t0 is output as the timing signal t0, the outputs from the gate 608 are output as the timing signals t1 to t7, and the outputs of the latch circuits 612ts0 to 612ts15 are output as the timing signals ts0 to ts15.

The latch circuits 601 and 612ts0 to 612ts15 receive the timing signal t0, and the counter 602 and latch circuits 604t0 to 604t7 receive the clock signal ck.

The above-mentioned system clock generator 600 generates latch clocks for the latch circuits that make up pipeline, such as the timing signals t0 to t7, timing signals ts0 to ts15, and the like, as shown in FIG. 15.

More specifically in the system clock generator 600, the latch circuit 601 latches USE information from the assignment memory 100 at the timing of the timing signal t0, and supplies it to the gate 608.

The counter value generated by the synchronization type counter 602 is input to the AND gate 603, and the output when all "1"s are obtained by the AND gate 603 is latched by the latch circuit 604t0 in response to the clock signal ck. The output from the latch circuit 604t0 at that time is output as the timing signal t0.

The latch circuit 604t1 latches the output from the latch circuit 604t0 in response to the clock signal ck, and supplies it as the timing signal t1 to the gate 608. Also, the latch circuit 604t2 latches the output from the latch circuit 604t1 in response to the clock signal ck, and supplies it as the timing signal t2 to the gate 608. Furthermore, the latch circuit 604t3 latches the output from the latch circuit 604t2 in response to the clock signal ck, and supplies it as the timing signal t3 to the gate 608. The subsequent latch circuits 604t3 to 604t7 similarly latch the outputs from the previous latch circuits in response to the clock signal ck, and supply them as the timing signals t3 to t7 to the gate 608.

When the USE information from the latch circuit 601 is "1", i.e., when the current channel is a used channel, the gate 608 outputs the timing signals t1 to t7 from the latch circuits 604t1 to 604t7; when the USE information from the latch circuit 601 is "0", i.e., when the current channel is an unused channel, the gate 608 does not output the timing signals t1 to t7 from the latch circuits 604t1 to 604t7.

Hence, the gate 608 outputs latch clocks for the latch circuits that constitute the pipeline in case of only the used channel.

On the other hand, the synchronization type counter 610 generates a counter value according to the count value of the counter 602 to the AND gate 611. The latch 612ts0 latches the output obtained when all "1"s are obtained by the AND gate 611, in response to the timing signal t0. The output from the latch circuit 612ts0 is output as the timing signal ts0.

The latch circuit 612ts1 latches the output from the latch circuit 612ts0 in response to the timing signal t0, and outputs it as the timing signal ts1. Also, the latch circuit 612ts2 latches the output from the latch circuit 612ts1 in response to the timing signal t0, and output it as the timing signal ts2. The subsequent latch circuits 612ts3 to 612ts15 similarly latch the outputs from the previous latch circuits, and output them as the timing signals ts3 to ts15.

As described above, in the electronic musical instrument 1, the timing signals t1 to t7 for the latch circuits that make up the pipeline are inhibited from being generated based on the USE information stored in the assignment memory 100 in case of an unused channel, and the number of times of switching of the individual circuits during this interval is reduced as much as possible. Especially, since a versatile LSI is normally constituted by CMOS elements that consume large electric power upon switching irrespective of Low/High output levels of the elements, the number of times of switching of the circuits is reduced as much as possible, thus attaining further power savings. As a result of power savings, the radiation amount of electromagnetic waves can be relatively reduced.

In the embodiments mentioned above, the wave generator 50 acquires waveform data from the external wave table 60. However, the present invention is not limited to such specific arrangement, and the wave generator 50 may generate waveform data by itself. In other words, the present invention is not limited to a wave generator which reads out waveform data from an external waveform ROM, and can also be applied to wave generators that adopt a sine synthesis method and FM sound source method.

Although 16-channel waveform data are accumulated into a single polyphonic tone generation data in the disclosed embodiments, some groups of channels may be individually accumulated into corresponding tone generation data, e.g., L/R-stereo tone generation data.

In the above embodiments, the speaker 80 actually produces tones corresponding to the generated music tones. A headphone or earphone set may be used in place of the speaker 80, and tones may be produced via the headphone or earphone set. With this arrangement, further power savings can be attained.

As described above, in the time slot of an unused tone generation channel, control data of that unused tone generation channel is inhibited from being read out from a storage means, so that the output of the storage means is not switched during this interval. Also, the arithmetic operation elements and the like inside the apparatus are not switched during this interval. Hence, since the numbers of times of switching in both the wave generator 50 and wave table 60 can be reduced, total power savings of the apparatus can be achieved. Especially, since a versatile LSI is normally constituted by CMOS elements that consume large electric power upon switching irrespective of Low/High output levels of the elements, when the number of times of switching of the elements is reduced as much as possible by applying the present invention, further power savings can be realized. As a result of such power savings, the radiation amount of electromagnetic waves can be relatively reduced.

In the time slot of an unused tone generation channel, control data of a used channel read out from the storage means immediately before that unused channel is held. During this interval, the arithmetic operation results obtained by the arithmetic operation elements and the like inside the apparatus based on the control data of the used channel are held, and no switching is done. Hence, the number of times of switching can be reduced.

Only control data of used tone generation channels are continuously read out from the storage means. With this arrangement, the output of the storage means is switched in only the time slots of used tone generation channels. Hence, since the output of the storage means is inhibited from being switched in the time slots of unused tone generation channels, the number of times of switching can be reduced.

After only the control data of used tone generation channels are continuously read out from the storage means, identical control data is output form the storage means in the remaining time slots. With this arrangement, the output of the storage means is not switched during this interval. Hence, the number of times of switching can be reduced.

After only the control data of used tone generation channels are continuously read out from the storage means, control data of the last channel is continuously output in the remaining time slots. With this arrangement, the output of the storage means is not switched while the control data of the last channel is being continuously output. Hence, the number of times of switching can be reduced.

In the time slot of an unused tone generation channel, the same music tone data as that obtained in the time slot of the previous used tone generation channel is output, and the output music tone data is gated before it is accumulated. Hence, every time identical music tone data is output, it can be prevented from being accumulated. Hence, total power savings can be achieved without causing any problems.

Furthermore, in the time slot of an unused tone generation channel, since latch clock signals are not supplied to latch means, processing circuits after the latch means are inhibited from being switched, thus reducing the number of times of switching. Hence, total power savings can be achieved more efficiently.

In the time slot of an unused tone generation channel, the previous read address of a waveform memory is held to inhibit the output of the waveform memory from being switched during this interval. Also, the arithmetic operation elements and the like inside the apparatus are not switched during this interval. Hence, since the numbers of times of switching in both the wave generator 50 and wave table 60 can be reduced, total power savings of the apparatus can be achieved.

Whether the current tone generation channel is used or unused is checked based on control data stored in the storage means by an external device, and in the time slot of an unused tone generation channel, the output of the waveform memory is inhibited from being switched. With this arrangement, the used/unused status of each tone generation channel can be arbitrarily set by the external device, and the output of the waveform memory can be reliably inhibited from being switched in only the time slot of an unused tone generation channel on the basis of the externally set used or unused status of the tone generation channel.

In the present invention, CMOS elements have been exemplified as elements that consume large electric power upon switching. However, the effect of the present invention is not limited to the CMOS elements as long as elements have similar characteristics.

What is claimed is:

1. A music tone generator which time-divisionally generates a plurality of music tone data in units of tone generation channels to form at least one polyphonic tone, comprising:

waveform generator means for generating waveform data in accordance with control data assigned to each channel in each of time slots corresponding to the tone generation channels;

time division control means for updating the control data in each time slot for the channel, and supplying the updated control data to said waveform generator means; and power saving means for suppressing operation of said waveform generator means by suspending update of the control data in a time slot of an unused channel in accordance with data indicating used/unused status of each channel.

2. A generator according to claim 1, wherein said time division control means comprises:

control data storage means having channel storage areas for storing the control data for tone generation channels; and addressing means for generating address data which increments, in units of time slots, an address that designates the channel storage area corresponding to the tone generation channel, and reading out the control data from the channel storage area in accordance with the address data.

3. A generator according to claim 2, wherein said power saving means comprises:

read-out control means for controlling said addressing means to inhibit the control data of the unused channel from being read out from said control data storage means in accordance with the data indicating the used/unused status of the channel.

4. A generator according to claim 3, wherein said read-out control means comprises:

holding means for, when the data indicating the used/unused status indicates a used channel, holding the address data corresponding to the channel; and means for, when the data indicating the used/unused status indicates an unused channel, supplying the address data output from said holding means to said control data storage means.

5. A generator according to claim 2, wherein said power saving means comprises:

read-out control means for controlling said addressing means to continuously read out only control data of used channels in a series of time slots from said storage means ahead of time on the basis of the data indicating the used/unused status.

6. A generator according to claim 5, wherein said read-out control means comprises:

means for, when the data indicating the used/unused status indicates an unused channel, supplying an increment clock for incrementing an address at a period sufficiently shorter than one time slot period so as to inhibit control data of the unused channel from being read out from said control data storage means; and means for, when the data indicating the used/unused status indicates a used channel, stopping increment of said addressing means until the next time slot to read out control data of the used channel from said control data storage means.

7. A generator according to claim 5, wherein said read-out control means fixes the address data for designating the channel storage area in remaining time slots of tone generation channels after the control data of used channels are continuously read out, and controls said addressing means to read out identical control data in those time slots.

8. A generator according to claim 7, wherein said read-out control means comprises:

last address detection means for detecting if the address data output from said addressing means corresponds to the last number of a series of tone generation channels; and means for stopping increment of said addressing means in accordance with an output from said last address detection means to fix the address data for designating the channel storage area, and to read out identical control data in the respective time slots.

9. A generator according to claim 2, wherein each of the channel storage areas corresponding to the channels in said control data storage means has control data storage segments for a plurality of types of control data, and said addressing means generates an address of the channel storage area and addresses of the control data storage segments in each time slot.

10. A generator according to claim 9, wherein one of the control data storage segments stores the data indicating the used/unused status, said addressing means issues an address of the control data storage segment that stores the data indicating the used/unused status at a start timing of each time slot, and said addressing means comprises means for supplying the data indicating the used/unused status read out from said control data storage means to said power saving means.

11. A generator according to claim 1, wherein said waveform generator means comprises:

a waveform memory for storing a plurality of waveform data as a sound source;

waveform memory address generator means for forming a read address of said waveform memory in accordance with the control data;

envelope generator means for generating amplitude envelope data of a tone generation waveform in accordance with the control data;

multiplier means for multiplying the waveform data read out from said waveform memory by the amplitude envelope data generated by said envelope generator means; and adder/accumulator means for accumulating the waveform data output from said multiplier means for channels to form the polyphonic tone signal.

12. A generator according to claim 1, wherein said time division control means comprises:

pipeline for supplying the control data in units of tone generation channels to said waveform generator means; and pipeline driving means for time-divisionally driving said pipeline, and said power saving means comprises:

means for stopping said pipeline driving means in a time slot of an unused channel in accordance with the data indicating the used/unused status of each channel.

13. A generator according to claim 12, wherein said pipeline driving means comprises:

latch means for latching the control data; and latch pulse supply means for supplying a latch pulse to said latch means in units of time slots of the channels, and said means for stopping said pipeline driving means suppresses the latch pulse of said latch means in the time slot of the unused channel in accordance with the data indicating the used/unused status of each channel so as to hold previous control data.

14. A generator according to claim 12, wherein said waveform generator means comprises:

a waveform memory for storing a plurality of waveform data as a sound source;

waveform memory address generator means for forming a read address of said waveform memory in accordance with the control data;

envelope generator means for generating amplitude envelope data of a tone generation waveform in accordance with the control data;

multiplier means for multiplying the waveform data read out from said waveform memory by the amplitude envelope data generated by said envelope generator means; and adder/accumulator means for accumulating the waveform data output from said multiplier means for channels to form the polyphonic tone signal, said time division control means comprises:

control data storage means having channel storage areas for storing the control data in units of tone generation channels; and addressing means for generating address data which increments, in units of time slots, an address that designates the channel storage area corresponding to the tone generation channel, and reading out the control data from the channel storage area in accordance with the address data, each of the channel storage areas corresponding to the channels in said control data storage means has control data storage segments for a plurality of types of control data, and said addressing means generates an address of the channel storage area and addresses of the control data storage segments in units of time slots.

15. A generator according to claim 14, wherein said waveform memory address generator means comprises:

latch means for respectively latching the control data that designate start and end address of one waveform data in said waveform memory;

looping means for generating address data for cyclically reading out between the start and end addresses;

latch means for latching the control data of a frequency number for determining a pitch of waveform data to be read out from said waveform memory in correspondence with a pitch of a tone; and adder/accumulator means for accumulating the frequency numbers of non-integers, and supplying upper digits constituting an integral part of the accumulated result as read address data between the start and end addresses to said looping means, and said power saving means suppresses latch pulses for said latch means in a time slot of an unused channel in accordance with the data indicating the used/unused status of each channel so as to hold previous control data.

16. A generator according to claim 14, wherein said waveform memory address generator means comprises:

output terminal latch means for latching the read address data to be supplied to said waveform memory, and said power saving means suppresses a latch pulse for said output terminal latch means in a time slot of an unused channel in accordance with the data indicating the used/unused status of each channel so as to fix the address data to be supplied to said waveform memory.

17. A generator according to claim 14, wherein said envelope generator means comprises:

latch means for latching control data for designating a change speed of the amplitude envelope;

latch means for latching control data for designating a target level for change of the amplitude envelope; and envelope arithmetic operation means for adding a value obtained by multiplying a difference between the accumulated value and the target level by the change speed data to an accumulated value of the amplitude envelope to form a new accumulated value as amplitude envelope data, and said power saving means suppresses latch pulses for said latch means in time slots of unused channels in accordance with the data indicating the used/unused status of the channels so as to hold previous control data.

18. A generator according to claim 14, wherein said envelope generator means comprises output terminal latch means for latching output amplitude envelope data to be supplied to said multiplier means, and said power saving means suppresses a latch pulse for said output terminal latch means in time slots of unused channels in accordance with the data indicating the used/unused status of the channels so as to fix the address data to be supplied to said waveform memory.

19. A generator according to claim 14, wherein said adder/accumulator means for performing accumulation for channels comprises:

an adder/accumulator for accumulating waveform data for all the channels; and gate means for supplying the waveform data from said multiplier means to said adder/accumulator in a time slot of a used channel and supplying zero data to said adder/accumulator in a time slot of an unused channel in accordance with the data indicating the used/unused status of the channels.

20. A generator according to claim 14, wherein said pipeline driving means comprises:

latch means for latching the control data; and latch pulse supply means for supplying a latch pulse to said latch means in units of time slots of the channels, said means for stopping said pipeline driving means comprises:

means for suppressing the latch pulse of said latch means in time slots of unused channels in accordance with the data indicating the used/unused status of the channels so as to hold previous control data, said latch pulse supply means comprises:

pulse generation means for sequentially generating latch pulses of the respective control data in the respective time slots in synchronism with generation of the addresses of the control data storage segments formed by said addressing means, and said means for stopping said pipeline driving means comprises:

gate means for allowing passage of the latch pulses output from said pulse generation means in a time slot of a used channel and blocking passage of the latch pulses in a time slot of an unused channel in accordance with the data indicating the used/unused status of the channels.

21. A generator according to claim 20, wherein one of the control data storage segments stores the data indicating the used/unused status, said addressing means issues an address of the control data storage segment that stores the data indicating the used/unused status at a start timing of each time slot, and said addressing means comprises means for supplying the data indicating the used/unused status read out from said control data storage means to said means for stopping said pipeline driving means.

22. A generator according to claim 1, wherein said waveform generator means comprises a CMOS LSI, and said power saving means suppresses switching of CMOS elements that make up said LSI in the time slot of the unused channel.

23. A music tone generator comprising:

address generator means for generating a read address of a waveform memory;

music tone generator means for generating music tone data on the basis of waveform data time-divisionally read out from the waveform memory in accordance with the read address generated by said address generator means, and adder/accumulator means for accumulating the music tone data generated by said music tone generator means and outputting at least one music tone data, wherein said address generator means holds the read address of the waveform memory to be a previous read address in a time slot of an unused tone generation channel.

* * * * *